US009975654B2

(12) United States Patent
Cere' et al.

(10) Patent No.: US 9,975,654 B2
(45) Date of Patent: May 22, 2018

(54) APPARATUS AND METHOD FOR CHANGING UNWINDING UNITS IN A WRAPPING MACHINE, AND UNWINDING APPARATUS

(75) Inventors: Mauro Cere', Loiano (IT); Mirko Casalboni, Rimini (IT)

(73) Assignee: Aetna Group, S.p.A. (IT)

( * ) Notice: Subject to any disclaimer, the term of this patent is extended or adjusted under 35 U.S.C. 154(b) by 826 days.

(21) Appl. No.: 14/238,497

(22) PCT Filed: Aug. 14, 2012

(86) PCT No.: PCT/IB2012/054125
§ 371 (c)(1),
(2), (4) Date: Feb. 12, 2014

(87) PCT Pub. No.: WO2013/024426
PCT Pub. Date: Feb. 21, 2013

(65) Prior Publication Data

US 2014/0174027 A1 Jun. 26, 2014

(30) Foreign Application Priority Data

Aug. 16, 2011 (IT) ..... MO2011A0211
Dec. 1, 2011 (IT) ..... MO2011A0312

(51) Int. Cl.
*B65B 11/02* (2006.01)
*B65B 59/04* (2006.01)
(Continued)

(52) U.S. Cl.
CPC ..... *B65B 11/025* (2013.01); *B65B 11/045* (2013.01); *B65B 41/16* (2013.01);
(Continued)

(58) Field of Classification Search
CPC . B65B 11/025; B65B 2210/18; B65B 11/008; B65H 49/00
(Continued)

(56) References Cited

U.S. PATENT DOCUMENTS 5,833,167 A * 11/1998 Thuer ..... B65H 19/12 242/559
6,276,116 B1 * 8/2001 Annila ..... B65B 11/00 53/211

(Continued)

*Primary Examiner* — Thanh Truong
*Assistant Examiner* — Dariush Seif
(74) *Attorney, Agent, or Firm* — Laubscher, Spendlove & Laubscher, P.C.

(57) ABSTRACT

An apparatus associated with a wrapping machine includes at least one unwinding unit for the wrapping machine for wrapping a load with a film, and shuttles that are movable along a path and suitable for receiving and supporting an unwinding unit to be replaced and to be dismantled from the wrapping machine, or a new unwinding unit to be mounted on the wrapping machine. The shuttles operate along a substantially horizontal operating direction to dismantle and receive from the wrapping machine an unwinding unit to be replaced or to transfer and mount on the wrapping machine a new unwinding unit. The apparatus includes a supporting unit fixed to the wrapping machine and arranged to be coupled to, and supported by, the unwinding unit, the unwinding unit including a first coupling device, and the supporting unit including a second coupling device, the first coupling device and the second coupling device being mutually coupled or uncoupled along the operating direction.

10 Claims, 27 Drawing Sheets

(51) Int. Cl.
*B65B 11/04* (2006.01)
*B65B 41/16* (2006.01)
*B65B 11/00* (2006.01)

(52) U.S. Cl.
CPC ..... *B65B 59/04* (2013.01); *B65B 2011/002* (2013.01); *B65B 2210/18* (2013.01)

(58) Field of Classification Search
USPC ..... 53/556, 168, 588, 389.2, 587; 242/559, 242/559.1, 559.3, 559.4
See application file for complete search history.

(56) References Cited

U.S. PATENT DOCUMENTS

| | | | | |
|---|---|---|---|---|
| 6,553,746 | B1 * | 4/2003 | Cere' | B65B 11/025 53/389.1 |
| 6,820,837 | B2 * | 11/2004 | Long | B65H 19/126 242/554.2 |
| 7,356,976 | B2 * | 4/2008 | Tosa | B65B 11/025 242/559.4 |
| 7,837,140 | B2 * | 11/2010 | Zitella | B65B 11/025 242/559.3 |
| 7,854,105 | B2 * | 12/2010 | Zitella | B65B 11/025 53/399 |
| 8,037,661 | B2 * | 10/2011 | Albert | B65B 11/04 100/12 |
| 2003/0066269 | A1 * | 4/2003 | Federeszyn | B65B 11/045 53/441 |
| 2005/0193687 | A1 * | 9/2005 | Tosa | B65B 11/025 53/399 |
| 2008/0229707 | A1 | 9/2008 | Zitella et al. | |
| 2010/0025517 | A1 * | 2/2010 | Cere | B65B 11/025 242/559.1 |

* cited by examiner

APPARATUS AND METHOD FOR CHANGING UNWINDING UNITS IN A WRAPPING MACHINE, AND UNWINDING APPARATUS

This application is a §371 National Stage of PCT International Application No. PCT/IB2012/054125. PCT/IB2012/054125 claims priority to IT Application No. MO2011A000211 filed Aug. 16, 2011 and MO2011A000312 filed Dec. 1, 2011. The entire contents of these applications are incorporated herein by reference.

BACKGROUND OF THE INVENTION

The invention relates to machines and methods for wrapping a load with a film of extensible synthetic plastic material. In particular, the invention relates to an apparatus and a method for automatically changing a film unwinding unit that is mounted on a wrapping machine. The invention further relates to a wrapping machine including such apparatus and to a film unwinding apparatus removably associated with a wrapping machine and a wrapping machine including such unwinding apparatus.

BRIEF DESCRIPTION OF THE PRIOR ART

Known wrapping machines generally include an unwinding unit supporting a reel from which synthetic plastic film is unwound to be wrapped around the load to form a series of strips or bands with helical or coiled trend, by virtue of the combination of the movement in the vertical direction of the unwinding unit and the reciprocal rotation between the latter and the load. The latter is typically composed of one or more products grouped and arranged on a bed or pallet.

In the wrapping machines provided with a rotating table for supporting the load, the latter is rotated around a vertical wrapping axis, whereas the unwinding unit is moved vertically with a reciprocating motion along a fixed column of the machine.

In the wrapping machines with a horizontal rotating ring or rotating arm, the load remains stationary during wrapping, while the unwinding unit is moved with respect to the latter, both rotating around the vertical wrapping axis and translating along the latter. For this purpose, the unwinding unit is fixed to a ring or an arm that is rotatably supported by a fixed structure of the machine and so as to rotate around the load.

In vertical rotating ring wrapping machines, the load is moved horizontally through the ring, while the unwinding unit rotates with the ring around a horizontal wrapping axis.

The unwinding unit typically includes a pair of pre-stretching rollers arranged for unwinding the film from the reel and pre-stretching or elongating the film, and one or more diverting or idle rollers that are arranged for diverting the film towards the load. By suitably adjusting the difference in the rotation speeds of the pre-stretching rollers, it is possible to pre-stretch by a defined amount or percentage the film exiting from the unwinding unit. By adjusting the rotation speed of the pre-stretching rollers, it is also possible to vary the unwinding speed of the film from the reel, i.e., the speed at which the film leaves the unwinding unit.

The unwinding unit generally includes an electric motor capable of rotating one of the two pre-stretching rollers that acts as a driving (master) roller and that drives, through a transmission/reduction unit, the other pre-stretching roller acting as a driven roller or slave.

In this manner, a preset transmission ratio is imposed between the quick roller and the slow roller, as a function of the pre-stretch that it is desired to obtain on the film. Unwinding units including two distinct electric motors are also known for independently driving the two pre-stretching rollers.

In the case of exhaustion, breaking, damage or jamming of the film, the reel has to be replaced with a new reel. Such replacement operation is generally carried out manually by an operator who, after stopping the machine and locating the unwinding unit at a suitable height from the ground, proceeds to remove the reel to be replaced from the corresponding supporting shaft and then inserts and locks a new film reel. At this point, it is necessary to remove from the new reel an initial portion of the film and wind it around the pre-stretching and idle rollers according to the required wrapping path, up to gripping pliers that are fixed to the weight-bearing structure of the machine and intended to keep the film in the initial wrapping step around the product.

These manual interventions, in addition to being heavy for the operator, require the presence and availability of the operator near the machine. In the case where the operator is absent or engaged in other activities, the replacement procedure can require machine downtimes that are also relatively long, with consequent reduction of the productivity of the machine.

In order to obviate such a drawback, apparatuses for replacing the reels are known, including a carriage bearing one or more new reels and that is movable away from or towards the machine. During reel replacement, the replacement carriage is near the machine for receiving the exhausted reel and releasing the new reel which is automatically inserted on the supporting shaft (swift) of the unwinding unit. In this way, reel replacement can be carried out automatically.

However, the above-mentioned apparatuses have the drawback that they require the manual winding of the initial film flap of the new reel around the rollers of the unwinding unit in order to allow the proper start of the machine. This preliminary winding operation, which is carried out manually, is laborious and slow, and determinates an increase of the time required for the reel replacement.

Apparatuses that are provided with devices for automatically carrying out the above-mentioned preliminary winding operation are also known.

However, such apparatuses, while allowing the replacement of the reel in a completely automatic manner, without the need for a manual intervention by an operator, are not very reliable. In particular, they do not ensure that the preliminary winding operation at each reel replacement is properly executed.

Apparatuses that are suitable for replacing the whole unwinding unit mounted on the wrapping machine are also known. In this case, once the film is finished, the unwinding unit that is mounted on the machine is removed from the machine, located on suitable supports, and replaced by an unwinding unit that is provided with a new film reel with the initial film flap already properly wound around the pre-stretching and idle rollers. The replacement unwinding unit is also located on a support that is adjacent to the machine so as to be able to be hooked onto and removed from the wrapping machine.

A drawback of the above-mentioned apparatuses is that the supports of the unwinding units have to be located adjacent to the machine to allow for the replacement of the unwinding units. In such positions, the supports, due to their overall dimensions, can considerably limit the effectiveness of the wrapping machine, in particular, the mounting of optional units and/or optional accessories. Such a drawback is particularly apparent in the case where the machine includes two or more unwinding units, and therefore a higher number of supports.

Furthermore, considering the proximity within the working zone of the wrapping machine, for safety reasons it is necessary to stop the machine to allow operators access to the support while inserting or removing the unwinding units. Such operations necessarily involve stopping the machine, thus reducing its productivity.

Another drawback is that mounting and dismantling the unwinding unit from the wrapping machine is very laborious and complex, since the procedure requires the movement of the wrapping machine, in particular of the ring or the rotating arm that supports the winding unit. Furthermore, the coupling device, which is necessary to fix the unwinding unit to the wrapping machine, is complex and expensive. The coupling device, besides allowing a reversible coupling for the mounting and dismantling, must also ensure firm and reliable locking of the unwinding unit to the machine, even for high rotation speeds of the machine.

Each unwinding unit includes, in addition to the film reel and the pre-stretching and unwinding rollers, the motor(s) necessary for driving the pre-stretching rollers. The unwinding unit further includes suitable connectors, which engage on complementary connectors that are provided on the wrapping machine to receive supply energy and control signals for the driving motors of the pre-stretching rollers.

A drawback of such replacement systems is that the above-mentioned unwinding units are equipped with film reel, motors, and pre-stretching and winding rollers which are very expensive and which necessitate at least two unwinding units in order to allow for rapid replacement and a decreased downtime of the wrapping machine.

SUMMARY OF THE INVENTION

An object of the invention is to improve the known apparatuses and methods to replace an unwinding unit in a wrapping machine.

Another object is to provide an apparatus and a method that allows an automatic, rapid, and efficient replacement of an unwinding unit in a wrapping machine, in particular of the type with a rotating ring or arm, or of the rotating platform type.

A further object is to obtain an apparatus that is compact and has reduced dimensions, such as not to limit in any manner the operation of the wrapping machine and to allow the mounting of optional units and/or accessories.

Another object is to make an apparatus that allows automatic replacement of a plurality of unwinding units, without requiring the intervention of operators.

Still another object is to provide an apparatus and a method that allows the unwinding unit to be reversibly mounted and locked to the wrapping machine.

A still further object is to make a wrapping machine that allows replacing an unwinding unit in an automatic, rapid, and efficient manner.

Another object is to provide a film unwinding apparatus that is removably associated with a wrapping machine and that allows replacing an unwinding unit in an automatic, rapid, and efficient manner.

Another further object is to provide an unwinding apparatus that performs different types of winding of the film around the rollers which unwind and pre-stretch the film.

Still another object is to provide an unwinding apparatus that is compact and inexpensive.

BRIEF DESCRIPTION OF THE FIGURES

The invention will be better understood and implemented with reference to the attached drawings, that illustrate some embodiments thereof by way of non-limiting example, in which.

DETAILED DESCRIPTION

Figure 1:
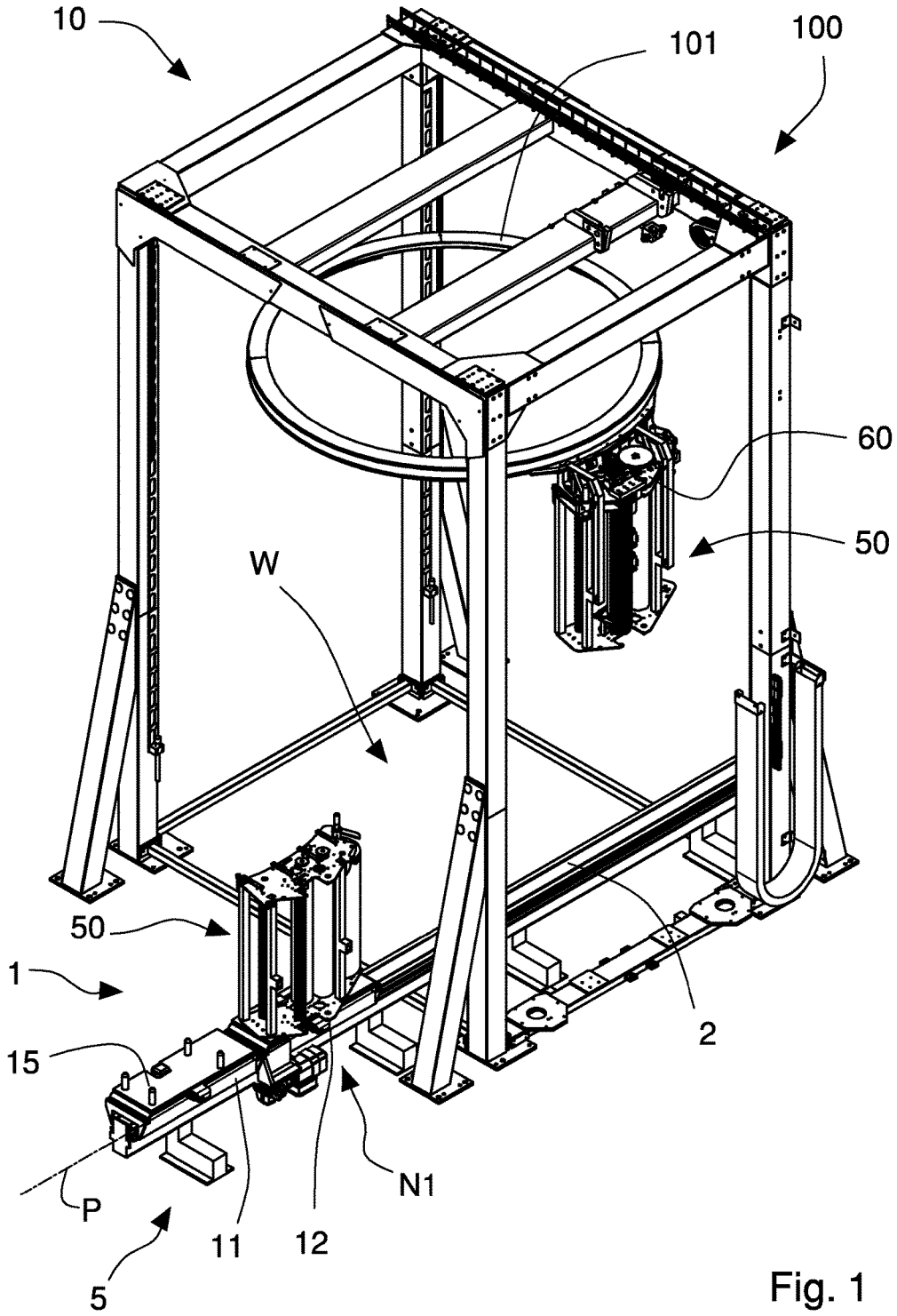
FIG. 1 is a perspective view of an apparatus for replacing an unwinding unit associated with an horizontal rotating ring wrapping machine.
Figure 2:
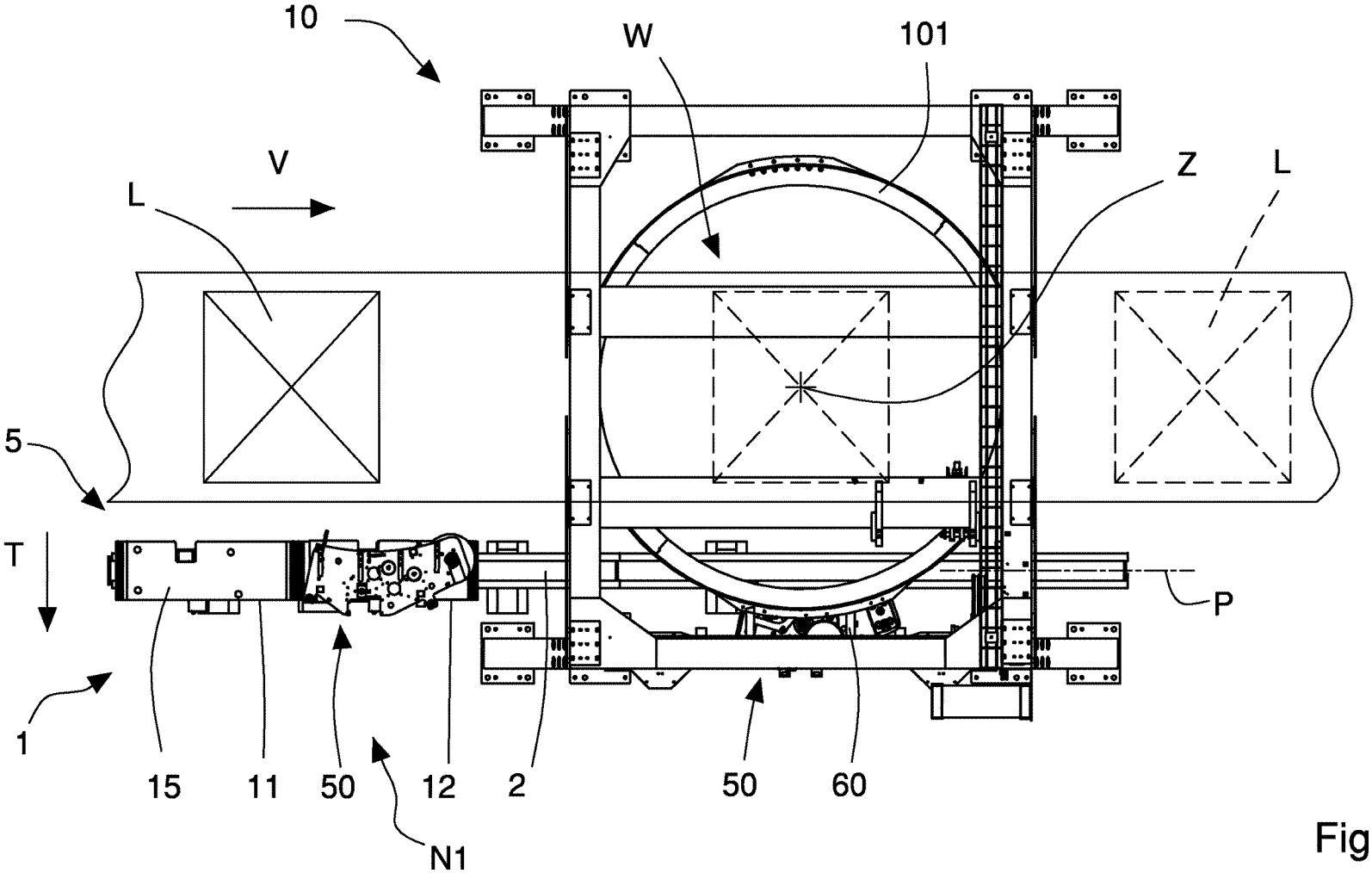
FIG. 2 is a top plan view of the apparatus and the wrapping machine of FIG. 1 in combination with a load to be wrapped in different successive positions.
Figure 3:
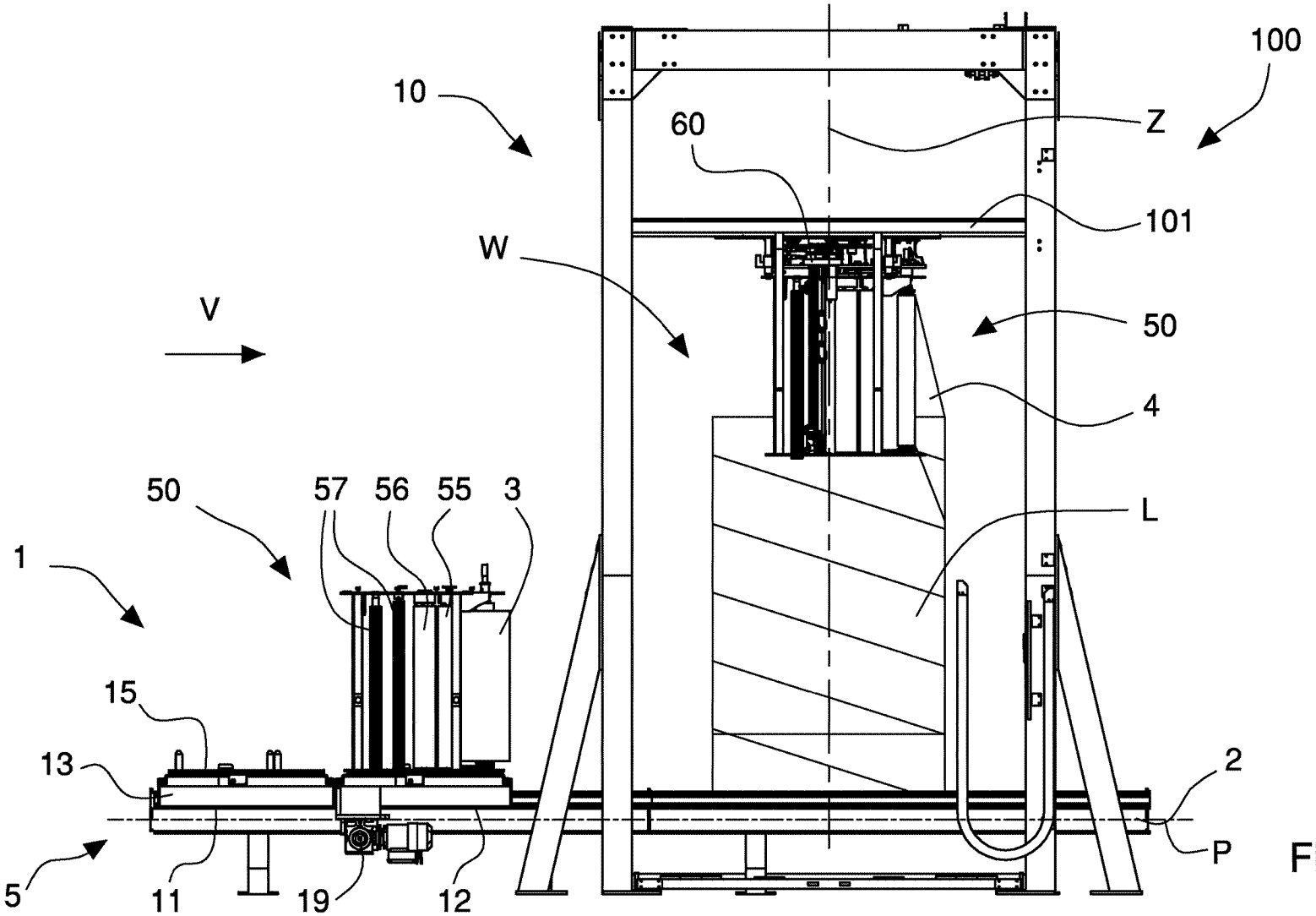
FIG. 3 is a front view of the apparatus and the wrapping machine of FIG. 1 in a wrapping procedure of a load with a film.

With reference to the FIGS. 1 to 3, there is illustrated the apparatus 1 according to the invention, arranged for changing unwinding units 50 of, and associated with a wrapping machine 10 for wrapping a load L with a film 4 of extensible synthetic plastic material.

The apparatus 1 of the invention includes at least one unwinding unit 50, a supporting unit 60 associated with the wrapping machine 10, and shuttles 11, 12 for moving the unwinding unit.

The wrapping machine 10 is, for example, provided with a horizontal ring 101, which is rotating around a vertical wrapping axis Z, and which is vertically movable so as to wrap the load L with helical coils or bands of film 4. The ring 101 is rotatably supported by a sliding frame (not illustrated) that is linearly movable along a vertical direction that is substantially parallel to the above-mentioned wrapping axis Z. On the ring 101, a supporting unit 60 is fixed, to which an unwinding unit 50 of the film 4 can be reversibly coupled. The ring 101 and the sliding frame act as a first movement mechanism 100 arranged for moving the supporting unit 60 and the unwinding unit 50 associated therewith with respect to the load L.

The unwinding unit 50, described more in detail below, includes a reel 3 of film 4 and rollers 55, 56, 57 arranged for unwinding and pre-stretching the film 4.

The unwinding unit 50 further includes a first coupling device 58 arranged to engage a second coupling device 68 provided on the supporting unit 60; the first coupling device 58 and the second coupling device 68 are mutually coupled or uncoupled along a substantially horizontal operating direction T, as better explained below.

The apparatus 1 includes shuttles 11, 12 suitable to house at least one unwinding unit 50 to be replaced and dismantled from the wrapping machine 10, and/or suitable for supporting at least one new or replacement unwinding unit 50 to be mounted on the wrapping machine 10. The shuttles 11, 12 move along the substantially horizontal operating direction T so as to disconnect from the wrapping machine 10, and therefore receive, an unwinding unit 50 to be replaced, and transfer and mount a new unwinding unit 50 on the wrapping machine 10, when the latter is located in a replacement configuration G.

The shuttles 11, 12 include a transfer device 15 suitable for receiving and supporting at least one unwinding unit 50, and movable between a retracted position D1 and an extended position D2 along the operating direction T so as to allow the shuttles 11, 12 selectively to dismantle and receive an unwinding unit 50 to be replaced or transfer and mount a new unwinding unit 50.

The operating direction T along which the transferring device 15 is moved is substantially radial to a circular wrapping trajectory of the film 4 around the load L.

The shuttles 11, 12 are also movable along a path P between a first operating position F1 in which they dismantle and receive from the wrapping machine 10 an unwinding unit 50 to be replaced (FIGS. 4, 5, 6), a second operating position F2 in which they transfer and assemble a new unwinding unit 50 on the wrapping machine 10 (FIGS. 7, 8, 9), and a non-operating or inactive position N1 in which they are outside a working zone W of the wrapping machine 10 in order to not interfere with the operation of the machine (FIGS. 1, 2, 3, 10).

To this aim, the shuttles 11, 12 include an actuator 19 that is able to move the shuttles 11, 12 along the path P.

The shuttles 11, 12 can further include breaks to stop the shuttles 11, 12 at least in the operating positions F1, F2 and in the non-operating position N1.

The operating direction T is transverse, in particular orthogonal, to the path P.

The shuttles 11, 12 include at least one shuttle provided with a respective actuator 19 for movement along the path P and arranged for supporting at least one unwinding unit 50.

Preferably, the shuttles include a plurality of shuttles 11, 12 connectable to one 10 another so as to form at least one convoy 5 of shuttles. At least one shuttle of the plurality of shuttles is provided with an actuator 19 to move the convoy 5. Each shuttle includes a transfer device 15 for supporting and moving at least one unwinding unit 50.

With reference to FIGS. 1 to 10, in the embodiment illustrated only by way of non-limiting example, a pair of shuttles 11, 12 are provided, each of which are arranged for receiving a respective unwinding unit 50 and provided with respective transfer device 15. At least one of the two shuttles, a so-called driving shuttle 12, is provided with an actuator 19 that allows for the controlled movement thereof (at least for position and speed) along the path P. The remaining shuttle 11, which is not provided with an actuator 19, a so-called driven shuttle 11, is interconnected to the driving shuttle 12. The driving shuttle 12 and the driven shuttle 11 are mutually connectable to form a convoy 5 of shuttles that is movable along the path P.

In a non-illustrated embodiment of the apparatus, the shuttles include two or more driving shuttles 12.

In a further embodiment of the apparatus, which is not illustrated, the shuttles include a driving shuttle 12 and a plurality of driven shuttles 11 connected thereto to form a convoy of shuttles suitable for housing a plurality of new unwinding units 50 to be then mounted on the wrapping machine to allow the latter to operate in a completely automatized manner, without intervention of operators, for prolonged work shifts.

In a still another embodiment of the apparatus of the invention which is not illustrated, only one shuttle is provided with an actuator and transfer device suitable for receiving and supporting one or more unwinding units 50. In another further version, a plurality of driving shuttles 12 and a plurality of driven shuttles 11 mutually connected so as to form a plurality of convoys 5 are provided.

Each shuttle 11, 12 includes a hook for connection with at least one adjacent shuttle to form a convoy of shuttles. The hook can be fixed, for example, screwable brackets or plates, or movable, in particular, selectively actuatable in order to engage or disengage with a hook of an adjacent shuttle so as to mutually connect or disconnect the shuttles and form or dismantle, respectively, a convoy of shuttles.

The apparatus includes a guide 2 for slidably supporting the shuttles 11, 12 along the path P. The guide 2 substantially includes a beam, in particular with a closed cross section, to which the shuttles 11, 12 are connected, and along which they can slide.

The guide 2 passes through the working zone W of the wrapping machine 10 and is substantially rectilinear and parallel to an advancing direction V of the load L in the wrapping machine 10.

Alternatively, the guide 2 can be curved and include at least one rectilinear portion at least at the two operating positions F1, F2.

As illustrated in the FIGS. 15 to 18, the shuttle 11 devoid of the actuator, the so-called driven shuttle 11, includes a carriage 13 provided with sliding wheels 14 and configured to engage and slide on the guide 2. The transfer device is slidably connected to the carriage 13 and includes a transfer platform 15 that is fixed by telescopic guides 18 to end portions of the carriage 13 so as to be movable between the retracted position D1 and the extended position D2 along the operating direction T.

An actuator 16 is provided for moving the transfer platform 15 along the operating direction T. The actuator 16 includes, for example, a pneumatic or electric linear actuator.

The transfer platform is provided with at least on stop 17 arranged for engaging with the unwinding unit 50 when the latter is located on the platform and to prevent undesired movements thereof in a plane parallel to the above-mentioned platform and orthogonal to the wrapping axis Z. The stops 17 include, for example, a plurality of pins suitable to engage respective holes provided on a lower portion of each unwinding unit 50.

The shuttle 12 provided with an actuator, the so-called driving shuttle, is substantially identical to the driven shuttle 11 except that it is provided with the actuator 19 that allows movement thereof along the guide 2.

The actuator 19 includes, for example, an electric motor fixed to the carriage 13, which rotate a gearwheel engaged with a rack fixed to the guide 2.

Alternatively, the electric motor of the actuator 19 can drive a pulley or a gearwheel that is coupled to fixed belt or chain transmission systems of the guide 2 so as to move the first driving shuttle 12.

Still alternatively, the actuator of the driving shuttle 12 can include a coupling device for connection to belt or chain transmission systems movable along the path P by a motor, for example an electric motor, which is associated with the guide 2. The actuator can be activated or deactivated for connecting or disconnected the first driving shuttle 12 to/from the transmission systems and to enable the shuttle to move or stop.

Figure 12A:
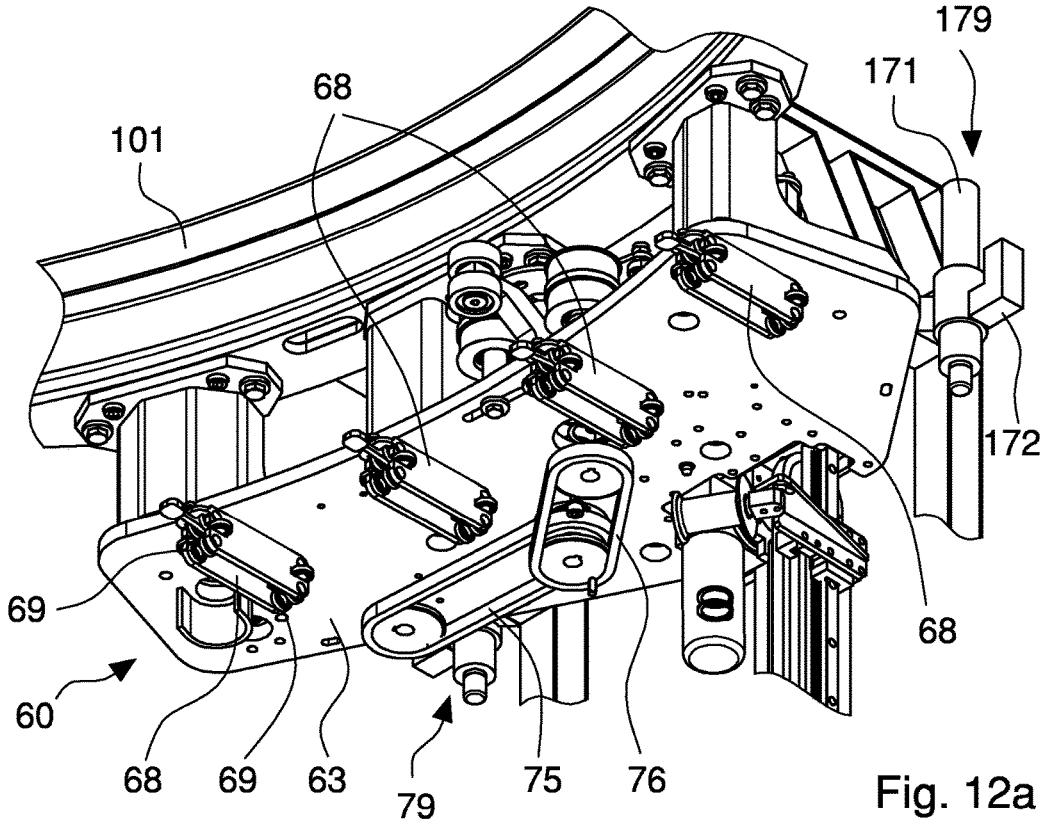
FIG. 12*a* is a partial and enlarged view of the apparatus of FIG. 12, illustrating in particular the supporting unit.
Figure 12:
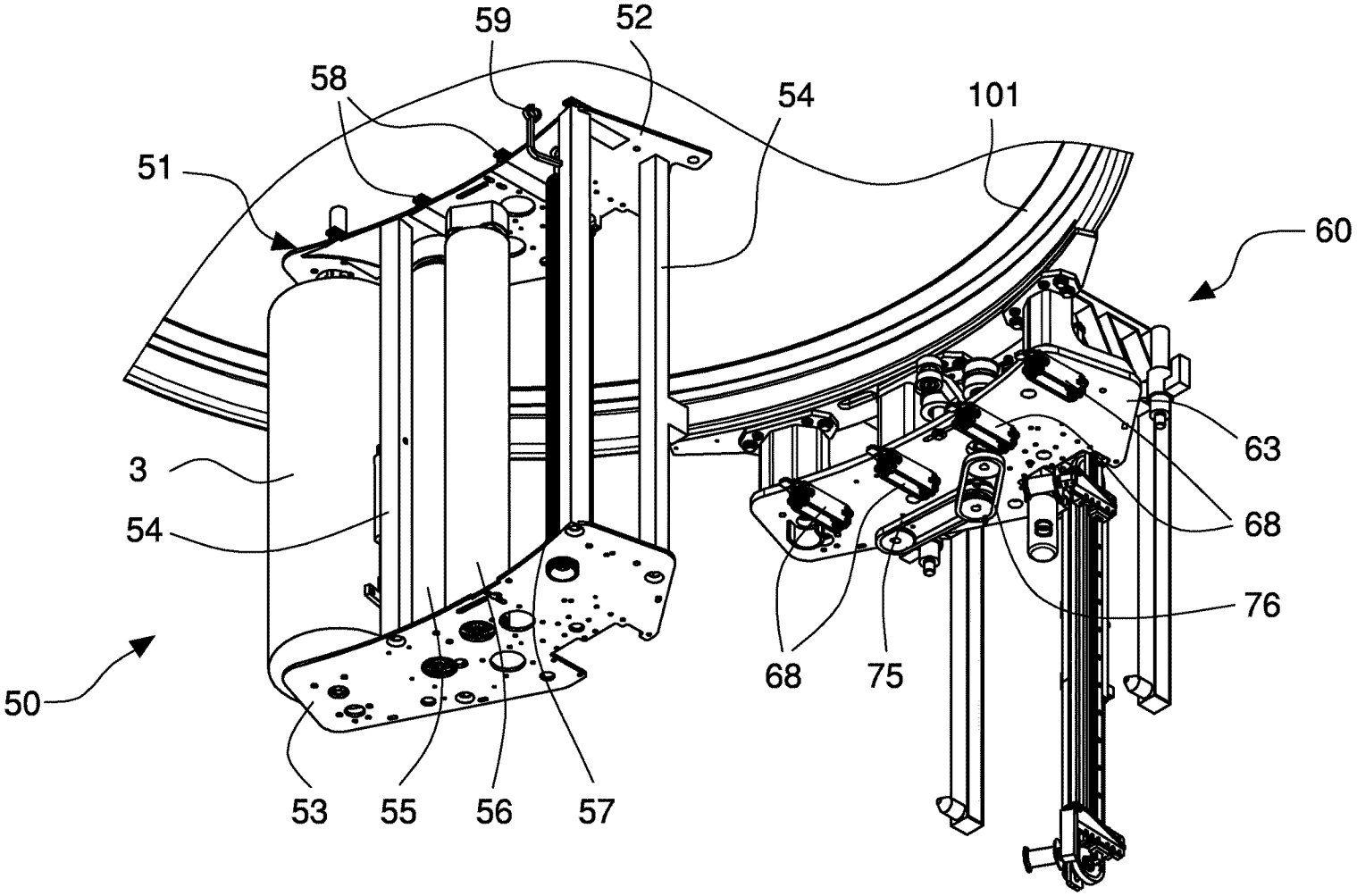
FIG. 12 is a partial and enlarged perspective view of the wrapping machine of FIG. 1, illustrating in particular the unwinding unit and a corresponding supporting unit mutually spaced apart.
Figure 14:
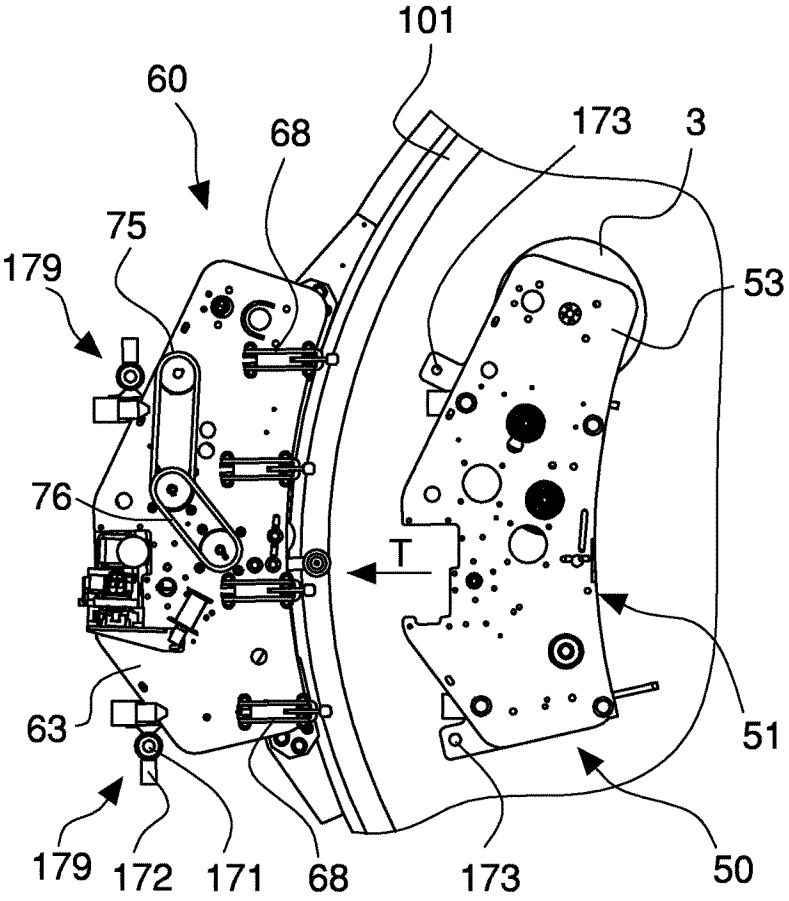
FIGS. 13 and 14 are plan views from the top and bottom, respectively, of the unwinding unit and the supporting unit of FIG. 12.
Figure 13:
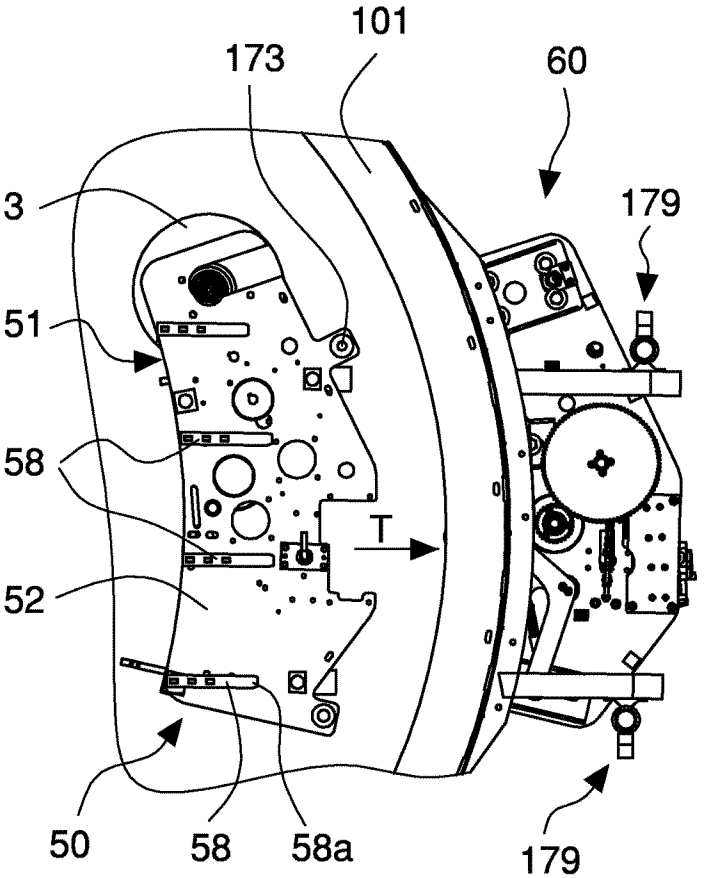
Figure 17:
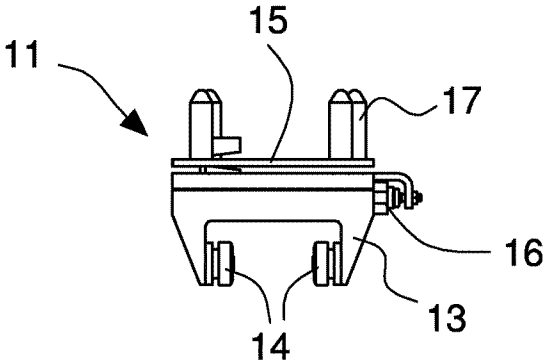
FIG. 17 is a side view of the first driven shuttle of FIG. 15.
Figure 18:
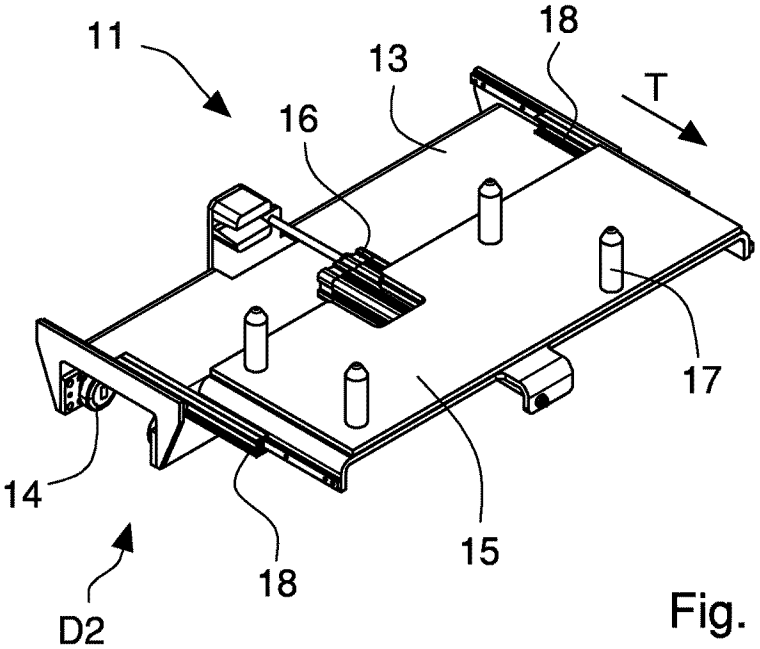
FIG. 18 is a top perspective view of the first driven shuttle of FIG. 15, with the transfer device in an extended position.
Figure 15:
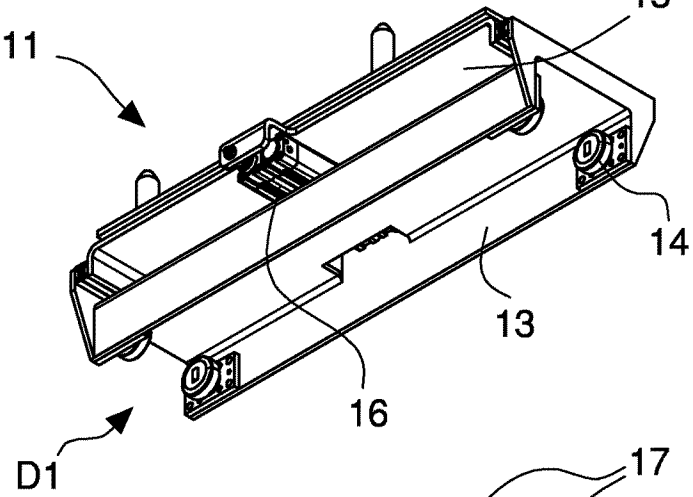
FIGS. 15 and 16 are perspective views from the bottom and top, respectively, of a first driven shuttle of the apparatus of FIG. 1 with a transfer device in a closed position.
Figure 16:
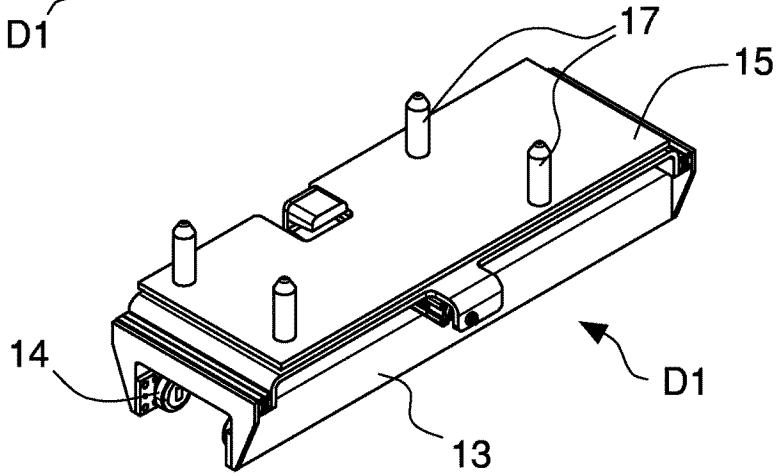

With particular reference to FIGS. 12 to 14, each unwinding unit 50 includes a supporting structure 51 suitable for supporting at least one reel 3 of film 4, and rollers 55, 56, 57 suitable for unwinding and pre-stretching the film. The supporting structure 51 includes, in particular, an upper portion 52 and a lower portion 53 formed by plates interconnected and spaced apart by a plurality of cross beams 54. The reel 3 of film 4, a pair of pre-stretching rollers 55, 56 and one or more diverting or idle rollers 57 are rotatably connected to the upper 52 and lower 53 plates. The pre-stretching rollers 55, 56 are rotated by a driving device provided on the supporting unit 60. The unwinding unit 50 is further provided with gripping device 59 suitable for retaining an initial flap of film 4 that is unwound from the reel 3 and wound around the pre-stretching 55, 56 and idle 57 rollers. The so-retained initial flap can be easily gripped by further gripping devices of a known type that are mounted on the wrapping machine 10.

As set forth above, the unwinding unit 50 includes a first coupling device 58 arranged for engaging with a second coupling device 68 of the supporting unit 60, the first coupling device 58 and the second coupling device 68 being mutually coupled or uncoupled along the operating direction T, which is substantially horizontal, transverse to the path P, and substantially radial with respect to the wrapping axis Z.

Figure 11:
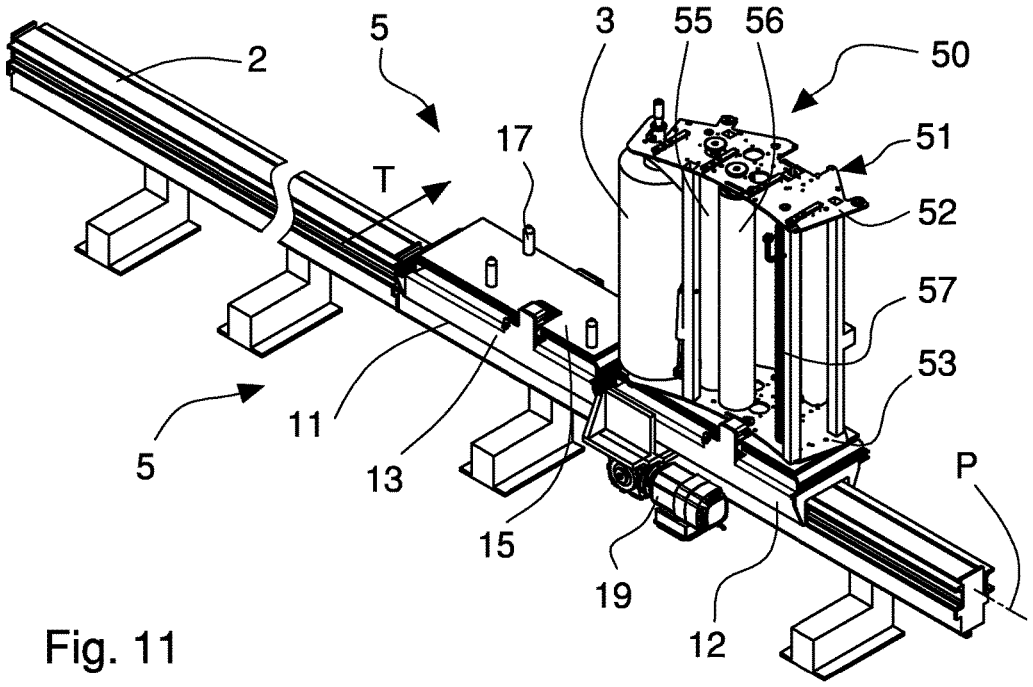
FIG. 11 is a fragmentary and partial perspective view of the apparatus of FIG. 1, particularly illustrating shuttles that are movable along a guide and supporting an unwinding unit.
Figure 11A:
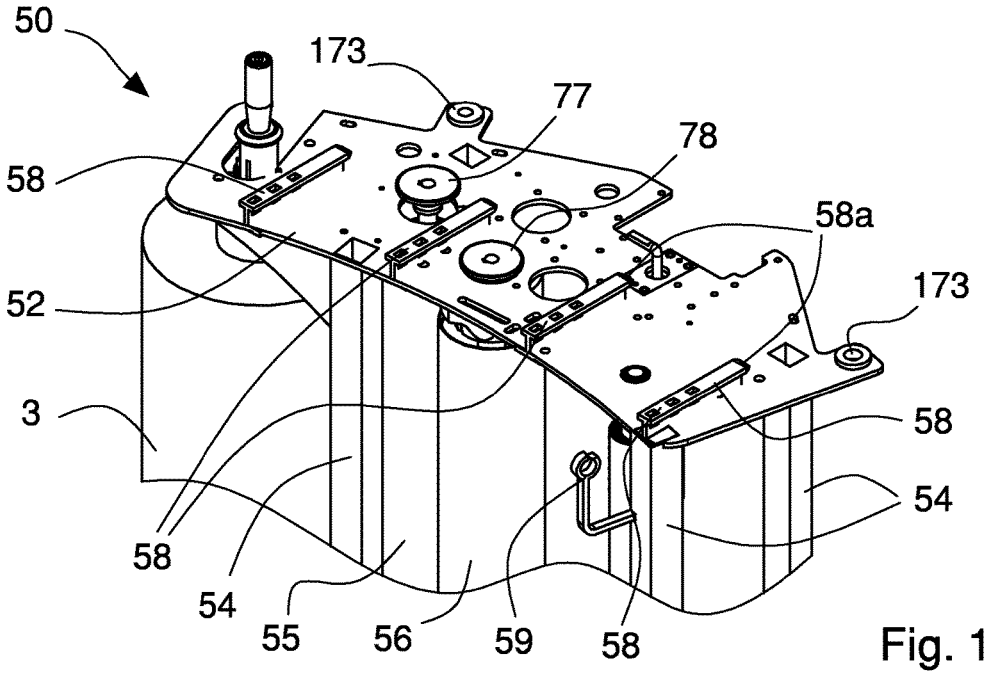
FIG. 11*a* is a partial and enlarged view of the apparatus of FIG. 11, illustrating an upper portion of the unwinding unit.

The first coupling device includes one or more rails 58, for example four, slidably inserted into, and engaged with, respective seats 68 of the second coupling device. The rails 58 have, for example, a T-shaped section, and have a front portion 58*a* that is tapered to allow easy insertion and proper centering and positioning in the corresponding seat 68 (FIG. 11*a*). The seat is provided with horizontal and vertical idle wheels 69, to allow for the sliding and centering of the respective rail 58 (FIG. 12*a*). The seats 68 act as self-centering sliding blocks for the respective rails 58.

The first coupling device 58 is associated with an upper portion 52 of the supporting structure 51, while the second coupling device 68 is associated with a lower portion 63 of the supporting unit 60. In particular, the rails 58 are fixed to an outer face of the upper plate 52, while the seats 68 are fixed to a respective lower plate 63 of the supporting unit 60.

The seats 68 are provided with abutments (not shown), which stop the further insertion and sliding of the rails 58, to stop the unwinding unit 50 in a coupling position B with respect to the supporting unit 60.

With reference to the configuration of apparatus and ring wrapping machine set forth in the FIGS. 1 to 14, the first coupling device 58 is insertable in the second coupling device 68 up to the coupling position B, in which the supporting unit 60 is engaged with and completely supported to the unwinding unit 50 along the operating direction T and with the advancing direction directed from rotational axis (the wrapping axis Z of the unwinding unit 50 around the load L) outwardly, i.e. with a direction that is in accordance with a centrifugal force acting on the unwinding unit 50 when the latter rotates around the load L. Owing to the configuration of the coupling device 58, 68, therefore, it is the same centrifugal force that keeps the unwinding units 50 properly assembled and connected in the coupling position B to the supporting unit 60. In other words, during the operation of the wrapping machine, it is the rotation of the ring 101 that prevents the unwinding unit 50 from accidentally disengaging and being disconnected from the supporting unit, i.e. from the machine, thus considerably increasing the safety of the machine.

Owing to the apparatus of the invention it is thus possible to mount and lock the unwinding unit to the wrapping machine in a reversible, safe, and reliable manner.

For greater safety, a locking device 179 can also be provided which is arranged for locking the unwinding unit 50 to the supporting unit 60 in the coupling position B. The locking device 179 includes a pair of locking pins 171 linearly driven by respective electro-magnets 172 and arranged to engage in corresponding openings 173 arranged on the upper plate 52 of the unwinding unit 50 to lock the reciprocal movement of the unwinding unit 50 with respect to the supporting unit 60 in the operating direction T, in particular in a disconnected direction.

With reference to FIG. 12*a*, the driving assembly of the supporting unit 60, which is arranged to rotate the pre-stretching rollers 55, 56 of the unwinding unit 50, includes a first flexible element 75, for example a first toothed belt 75, and a second flexible element 76, for example a second toothed belt 76, arranged to be abutted and engaged by a first coupling pulley or gearwheel 77 of the first pre-stretching roller 55 and by a second coupling pulley or gearwheel 78 of the second pre-stretching roller 56. The toothed belts 75, 76 of the driving assembly can be driven by at least one motor arranged on the supporting unit 60 or located on a frame of the wrapping machine and connected to the driving assembly by motion transmission systems of a known type.

Alternatively, the driving motor or motors of the pre-stretching rollers 55, 56 can be provided directly on the unwinding unit, the supporting unit being in this case not provided with a driving assembly and optionally provided with an electrical power supply for the above-mentioned motors. Versions of the apparatus with this type are illustrated in the FIGS. 19 to 25 described herein below.

FIGS. 1 to 10 illustrate successive steps of a replacement or change procedure of an unwinding unit 50 to be replaced, mounted on board of the wrapping machine 10, with a new or replacement unwinding unit 50 located on the shuttle means 11, 12.

Figure 4:
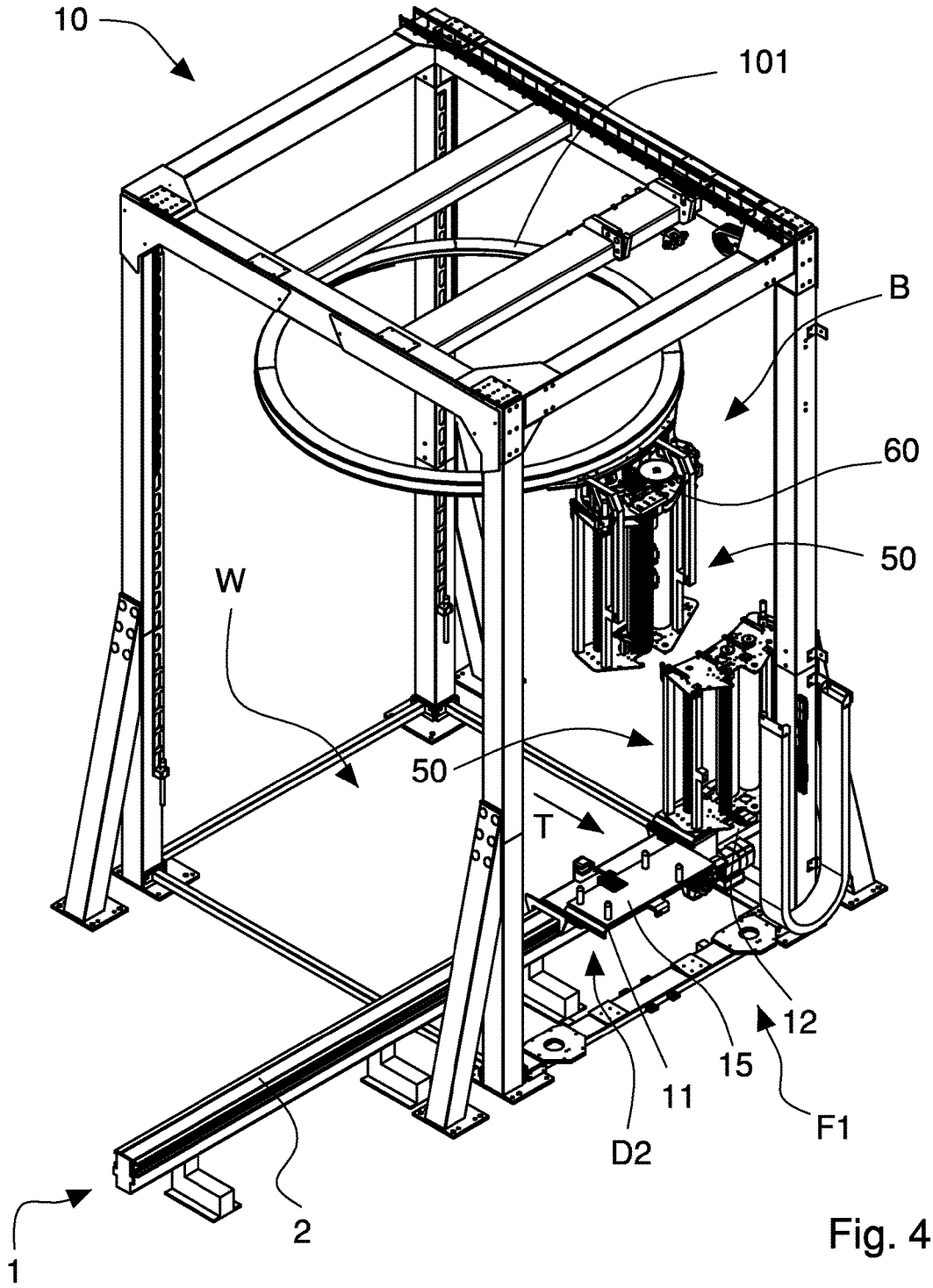
FIGS. 4 to 10 are complete or partial perspective views of the apparatus and the wrapping machine of FIG. 1 in successive operating steps, respectively, of a replacement procedure of an unwinding unit.
Figure 5:
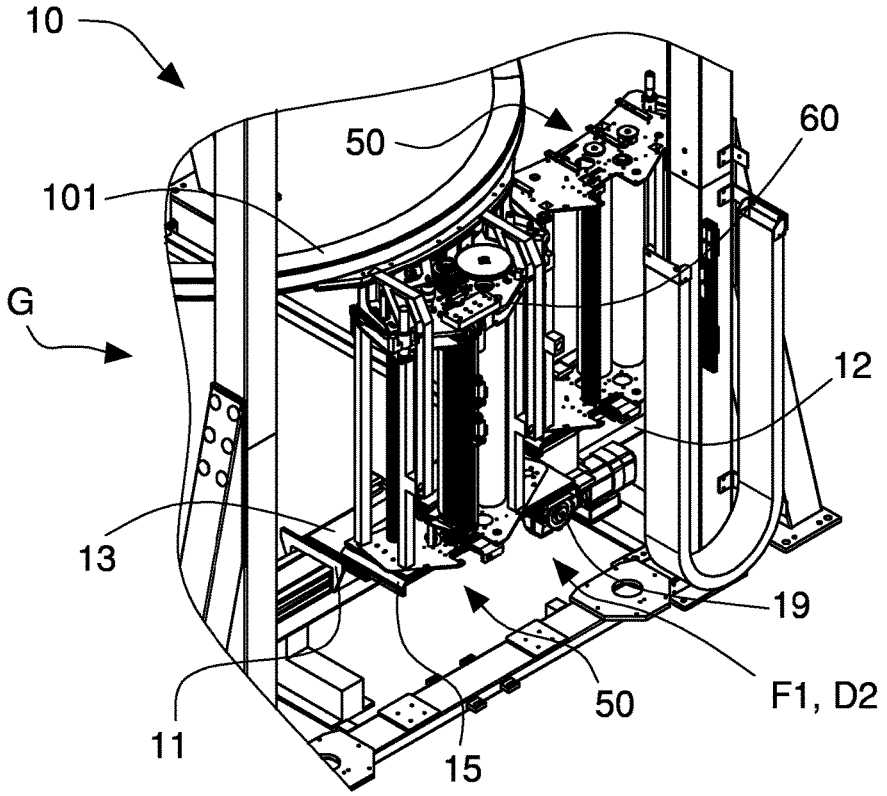
Figure 6:
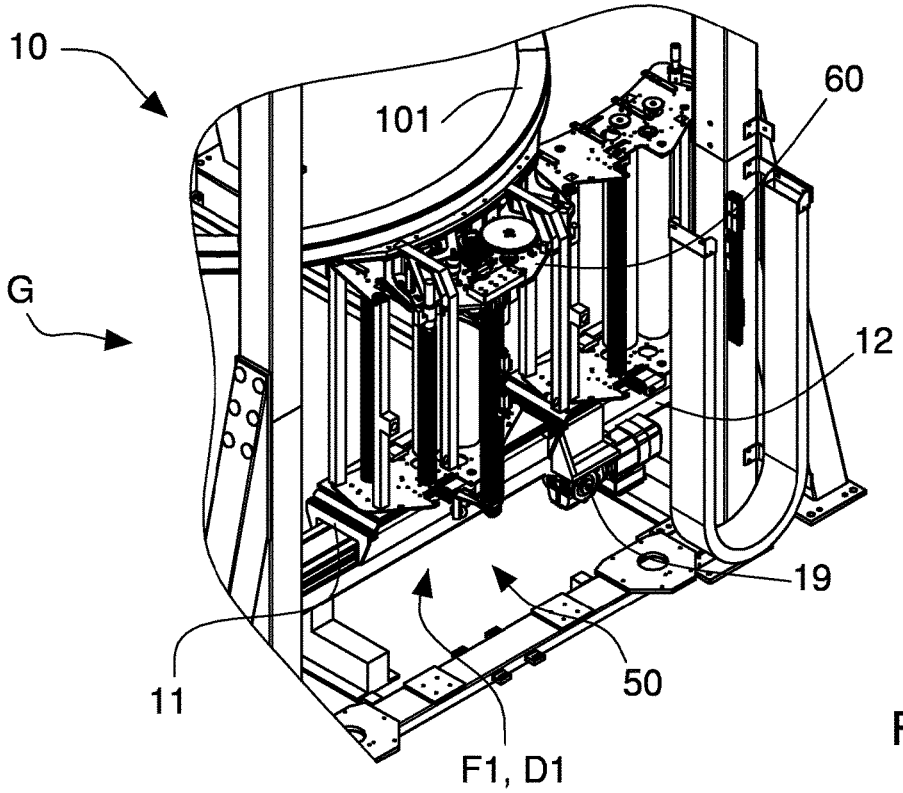

In an initial step, the shuttles 11, 12 from the inactive position N1, outside the working zone W of the wrapping machine 10 to allow the free operation of the machine during the wrapping of the load, are moved in the first operating position F1 within the working zone W (FIG. 4). In the first operating position F1 the free shuttle, i.e. not provided with a new or replacement unwinding unit 50 (the driven shuttle 11 in the illustrated example) is precisely under the rotating ring 101, the transfer device 15 being in the extended position D2 to receive the unwinding unit 50 to be replaced. The machine is arranged in the replacement configuration G with the rotating ring 101 vertically lowered to rest the unwinding unit 50 to be replaced on the platform of the transfer device 15 of the driven shuttle 11 (FIG. 5). The stop 17 engages the unwinding unit 50 to be replaced so that the movement of the platform of the transfer device 15 in the retracted position D1 allows the unwinding unit 50 to be replaced from the supporting unit 60 and disengaged and dismantled from the rotating ring 101 (FIG. 6). The locking device 179 is disengaged from the unwinding unit 50 to be replaced to allow the first coupling device 58 sliding in the operating direction T, from the outside inwardly with reference to the rotating ring 101, and disengaging from the second coupling device 68.

Figure 7:
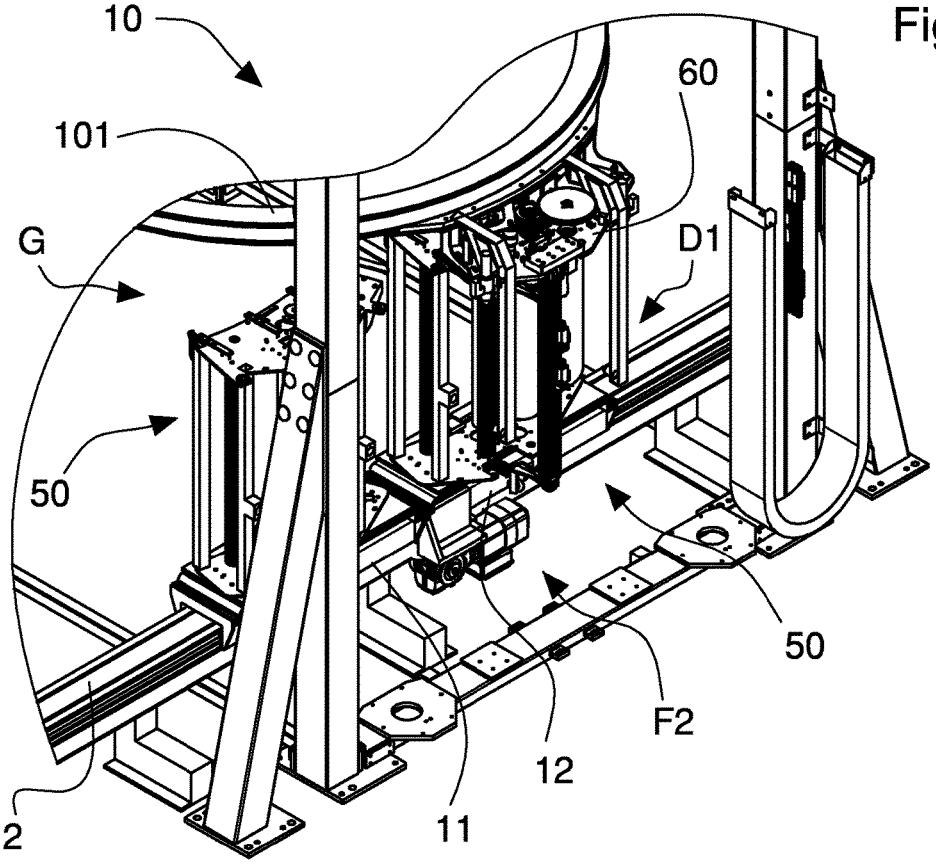
Figure 8:
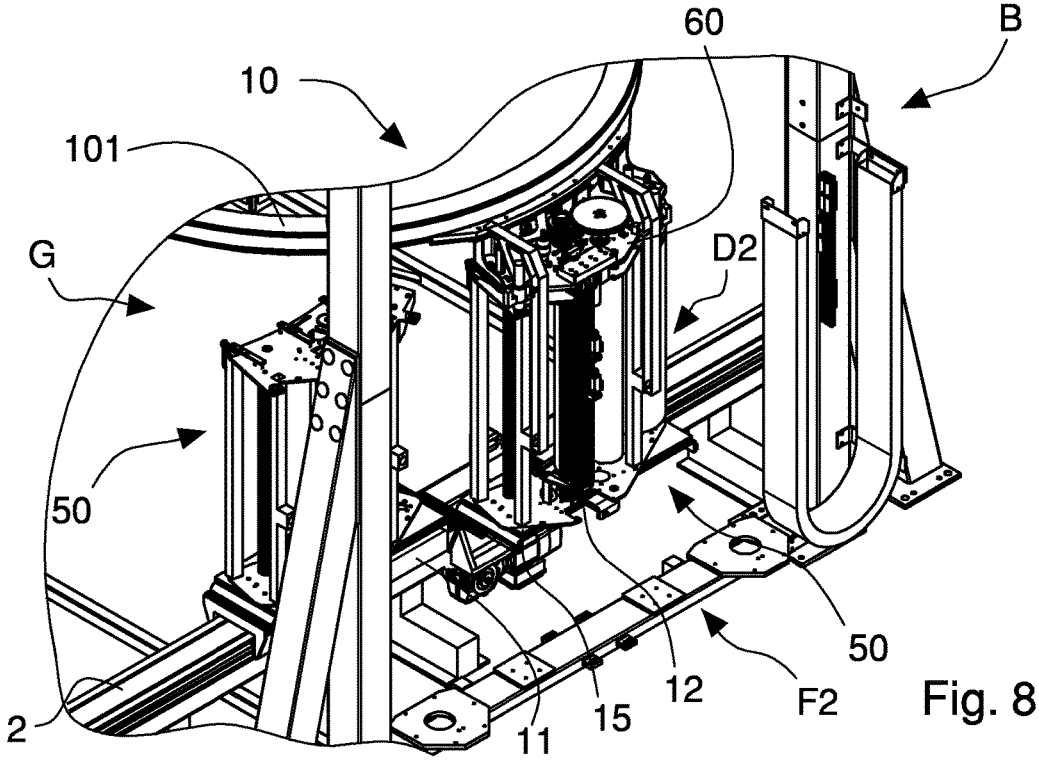
Figure 9:
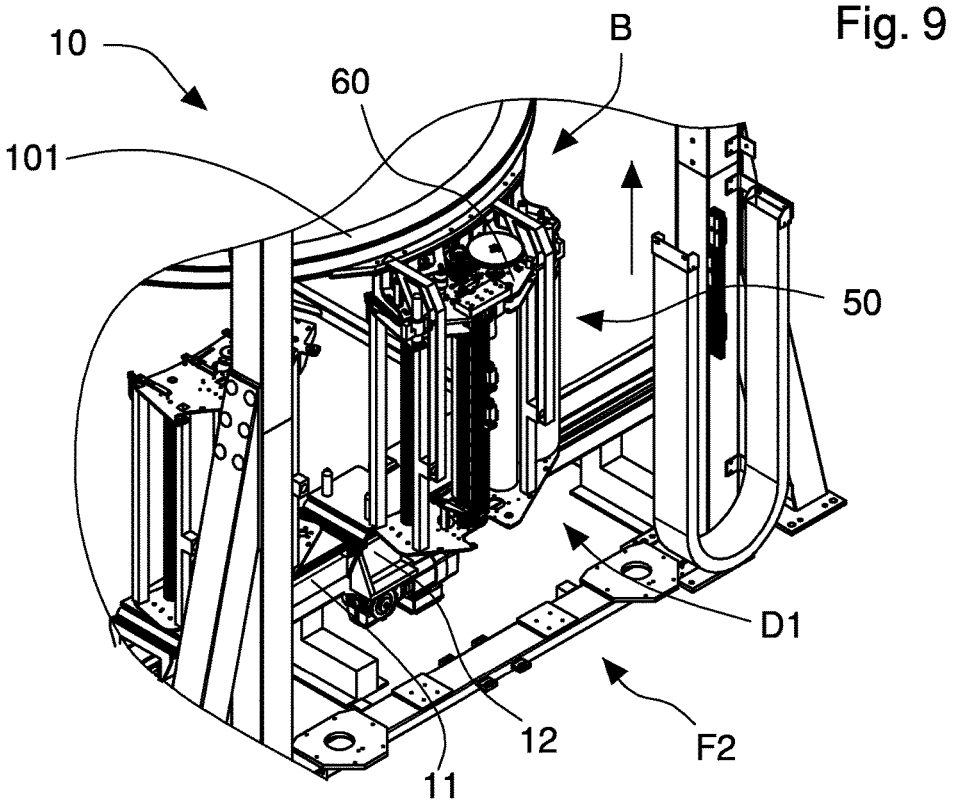
Figure 10:
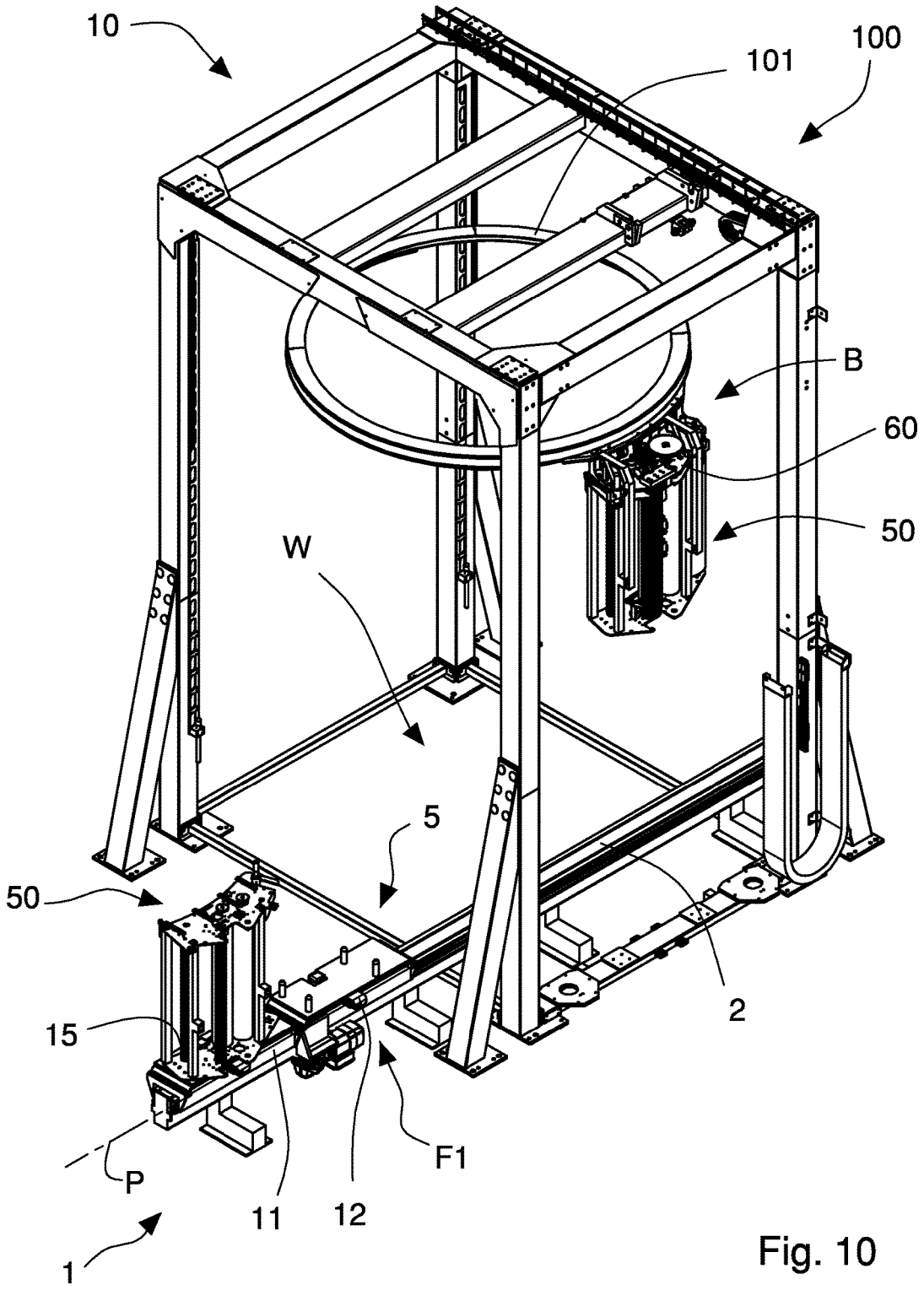

Since in the retracted position D1 of the shuttles 11, 12, the unwinding unit 50 to be replaced is disconnected and spaced apart from the supporting unit 60, the shuttles 11, 12 can be moved in the second operating position F2, at which the shuttle provided with unwinding units 50 (the driving shuttle 12 in the illustrated example) is at the supporting unit 60 (FIG. 7). At this point, the transfer device 15 of the driving shuttle 12 is moved to the extended position D2 to mount the new unwinding unit 50 on the supporting unit 60 (FIG. 8). More precisely, the first coupling device 58, i.e., rails, is slidably inserted in the second coupling device 68, i.e., seats with rollers. In the extended position D2 of the transfer device 15, the unwinding unit 50 is in the coupling position B with respect to the supporting unit. The locking device 179 can thus be driven for locking the unwinding unit 50 to the supporting unit 60.

At this point, the rotating ring 101 is vertically moved so as to disengage the unwinding unit 50 from the stop 17 of the driving shuttle 12. The shuttles 11, 12 are thus moved simultaneously with the rotating ring 101 along the path P, from the second operating position F2 to the inactive position N1, outside the working zone to allow the wrapping machine carrying out the wrapping cycles of the load.

Owing to the apparatus of the invention, it is thus possible to automatically, rapidly and efficiently replace an unwinding unit in a wrapping machine, without any interventions by operators.

Furthermore, the wrapping machine provided with the apparatus of the invention can operate autonomously for a prolonged work shift, without the intervention of operators since the shuttles can support, and therefore replace, a plurality of unwinding units.

Furthermore, the mounting and dismantling procedure of the unwinding unit on and from the wrapping machine is easy and rapid, and it does not require the movement of the rotating ring 101 of the wrapping machine, which only has to be arranged in the replacement configuration G. Consequently, replacement time is reduced.

Another advantage of the apparatus 1 is that the guide 2, which passes through the working zone W of the wrapping machine 10 parallel to an advancing direction V of the load, allows the shuttles 11, 12 to reach the operating positions F1, F2 for the easy replacement of the unwinding units 50. The overall dimensions of the machine are reduced compared to the known wrapping machines that are provided with apparatuses for the replacement of the film reel or the unwinding unit. Furthermore, in the inactive position N1, the shuttles 11, 12 are external to the working zone W so as not to limit in any manner the operability of the wrapping machine, as well as not to prevent the assembling and operation of optional units and/or accessories.

Figure 19:
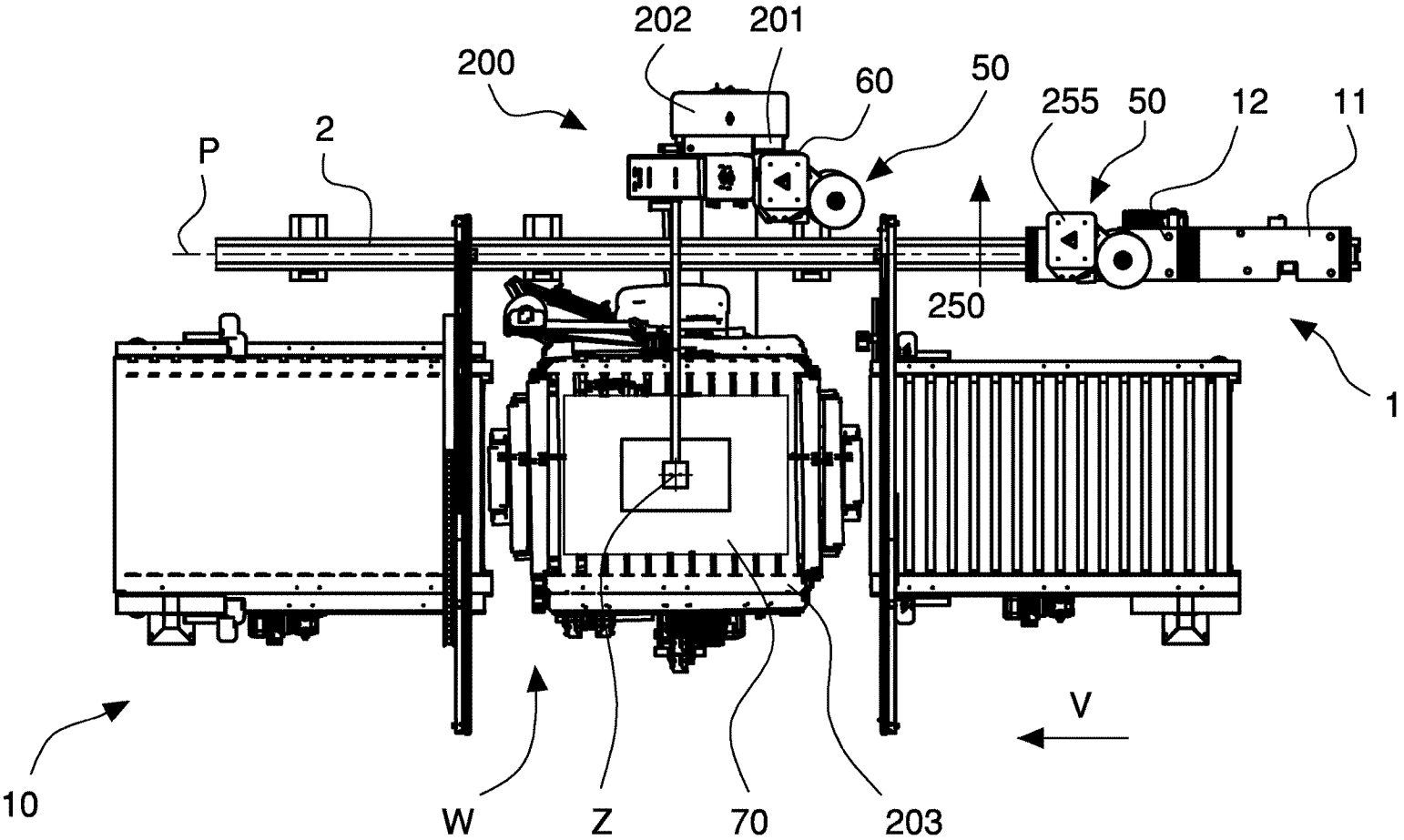
FIG. 19 is a top plan view of a version of the apparatus for replacing unwinding units of the invention, which is associated with a rotating platform wrapping machine.

FIG. 19 illustrates an embodiment of the apparatus 1 for replacing unwinding units of the invention, associated with a wrapping machine 10 of the rotating platform type. In this wrapping machine 10, the supporting unit 60 is mounted on a first wrapping carriage 201 that is vertically movable along a fixed first column 202. The first wrapping carriage 201 and the first column 202 act as a second movement mechanism 200 arranged for moving the supporting unit 60 and the unwinding unit 50 with respect to the load L.

The shuttles 11, 12 are arranged for dismantling and receiving from the wrapping machine 10 an unwinding unit 50 to be replaced, and then transferring and mounting a new replacement unwinding unit 50 on the wrapping machine 10. The shuttles 11, 12 are movable along the guide 2 that defines the path P and which is interposed between the first column 202 and the unwinding unit 50 and a first rotating table 203 supporting and rotating the load L. The guide 2 is substantially rectilinear and parallel to an advancing direction V of the load L through the working area W of the wrapping machine 10.

The unwinding unit 50 differs from the unwinding unit disclosed above in that it includes, besides the film reel and the pre-stretching and idle rollers, a first motor 255 for rotating pre-stretching rollers. In this embodiment of the apparatus 10, the supporting unit 60 is not provided with a mechanical driving assembly for the pre-stretching rollers, but includes a connection device of a known type and not shown to provide to the unwinding unit 50 and in particular to the first motor 255, signals and controls, electric power, pneumatic energy.

The replacement or change procedure of the unwinding unit 50 to be replaced, mounted on the wrapping machine 10, with the new unwinding unit 50, located on the shuttles 11, 12, is substantially identical to the procedure described above with reference to the embodiment set forth in the FIGS. 1 to 10. In this case, the supporting unit 60 is mounted on the wrapping carriage 201 sliding along the first column 202 in the replacement configuration G to allow the shuttles 11, 12 replacing the unwinding unit 50 to be replaced and mounting the new unwinding unit 50.

Figure 20:
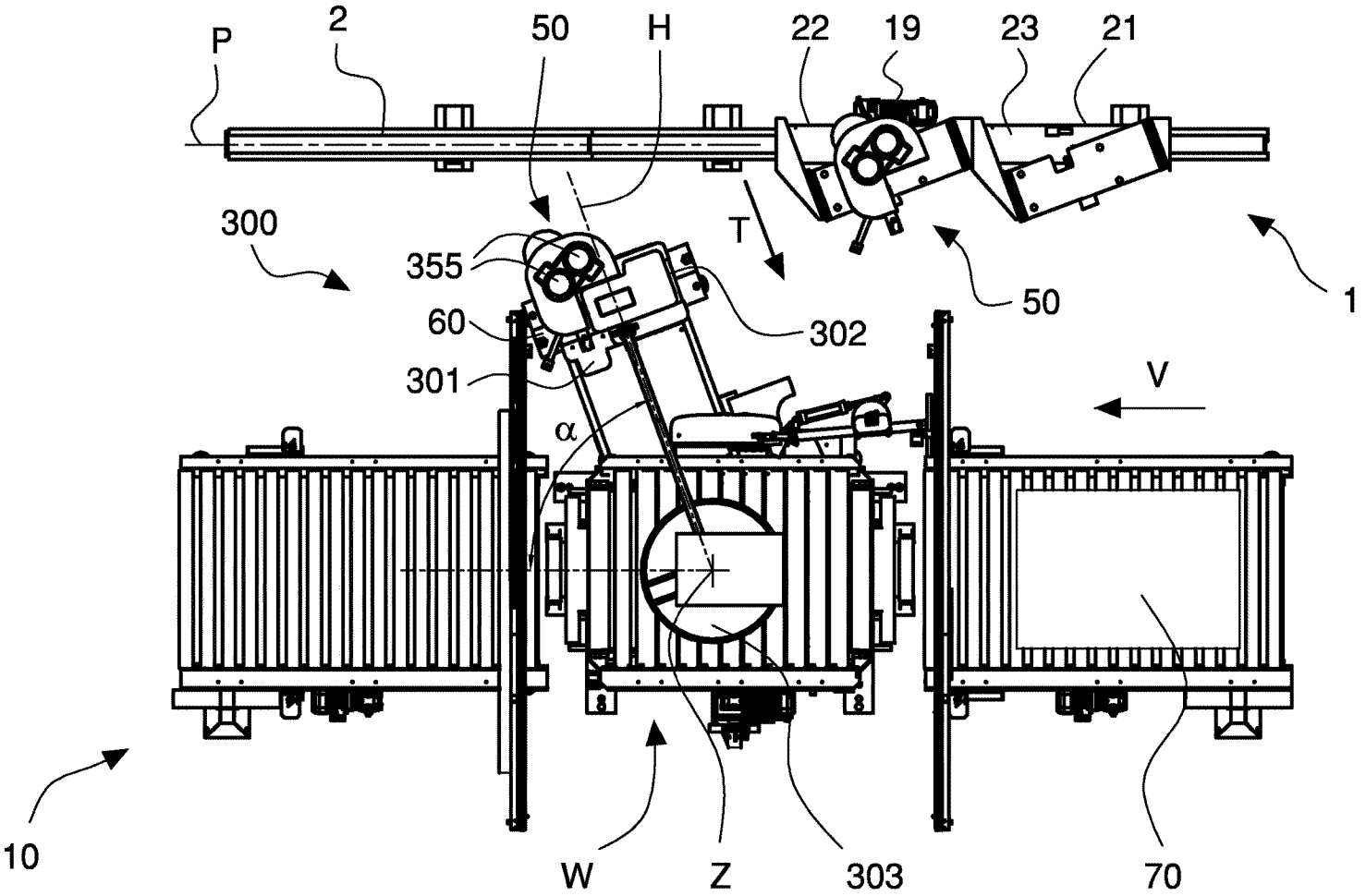
FIG. 20 is a top plan view of another version of the apparatus for replacing unwinding units of the invention, which is associated with a rotating platform wrapping machine with a tilted column.
Figure 22:
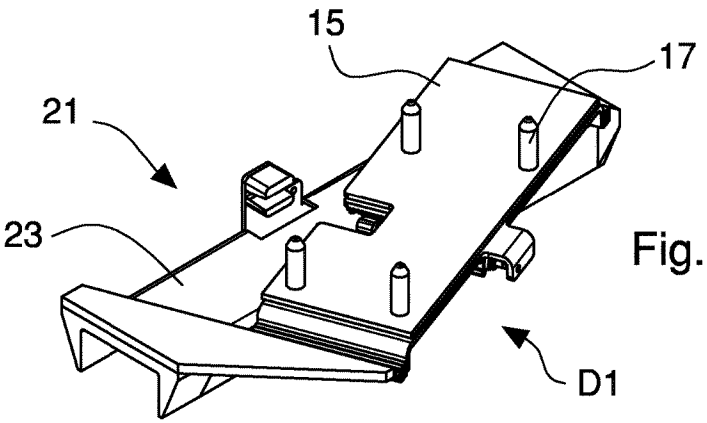
FIGS. 21 and 22 are perspective views from the bottom and top, respectively, of a second driven shuttle of the version of the apparatus of FIG. 20 with respective transfer devices in a closed condition.
Figure 24:
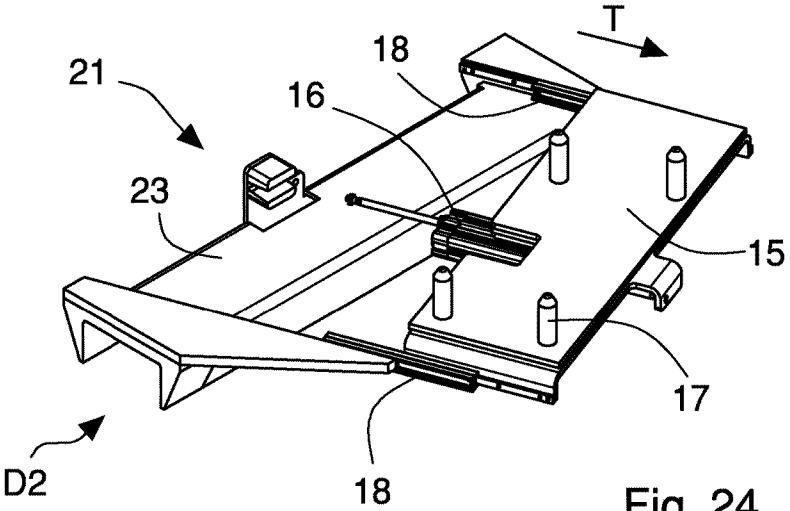
FIG. 24 is a top perspective view of the second driven shuttle of FIG. 21, with respective transfer devices in an extended condition.
Figure 21:
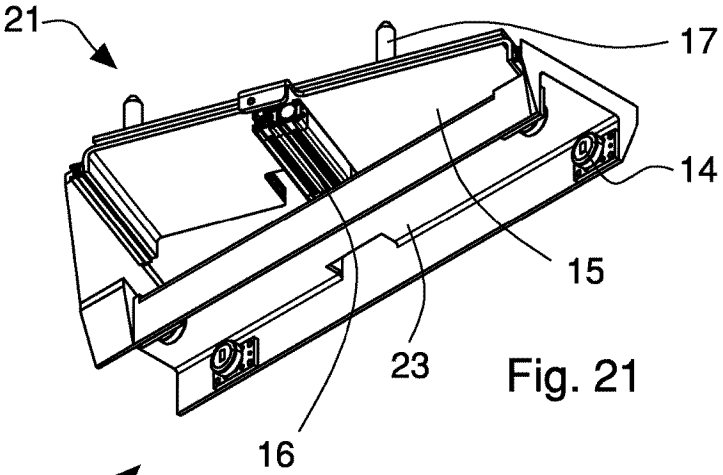
Figure 23:
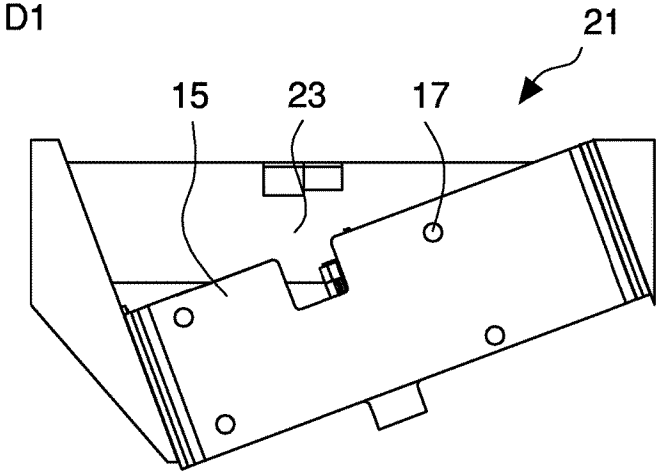
FIG. 23 is a top plan view of the second driven shuttle of FIG. 21.

FIG. 20 illustrates another version of the apparatus 1 to replace unwinding units of the invention, associated with a wrapping machine 10 of the rotating platform type and provided with a fixed second column 302, arranged adjacent to a second rotating table 303 and tilted relative to the advancing direction V of the load L through the machine. More precisely, the second column 302 is located in plan view so that a vertical plane H passing through a longitudinal axis thereof, and through the wrapping axis Z, is tilted by an angle $\alpha$. that is not a right angle, relative to the above-mentioned advancing direction V.

The second column 302 slidably supports a second wrapping carriage 301 to which the supporting unit 60 for the unwinding unit 50 is fixed.

The second wrapping carriage 301 and the second column 302 act as a third movement mechanism 300 arranged for moving the supporting unit 60 and the unwinding unit 50 associated thereto with respect to the load L.

In this embodiment of the apparatus, the guide 2 along which the shuttles slide, is substantially rectilinear and parallel to the advancing direction V and, is external to the second column 302 and does not pass through the working area W of the wrapping machine 10.

The shuttles further include shuttles 21, 22 differing from the shuttles of the embodiments described before in that the corresponding transfer devices 15 are movable along the operating direction T that is tilted with respect to the path P defined by the guide 2 by the same angle $\alpha$ of the vertical plane H, in order to allow dismantling and mounting of the unwinding units 50.

In particular, with reference to the FIGS. 21 to 24, the further shuttle that is not provided with an actuator, the so-called further driven shuttle 11, includes a further carriage 23 slidably supporting the respective transferring platform of the transfer device 15 that is fixed, by telescopic guides 18, to tilted end portions of the carriage 23 for movement between the retracted position D1 and the extended position D2 along the tilted operating direction T. Actuator 16 is provided for moving the above-mentioned transfer platform 15 along the operating direction T. The transfer platform is provided with stops 17 arranged for engaging the unwinding unit 50 when the latter is located on the platform. The further carriage 23 is provided with sliding wheels 14 to engage and slide on the guide 2.

The further shuttle provided with an actuator, the so-called further driving shuttle 22, is substantially identical to the further driven shuttle 21 except that it is provided with a n actuator 19 that allows for the movement thereof along the guide 2.

The unwinding unit 50 is provided with a pair of second motors 355 suitable for separately and independently moving the pre-stretching rollers. In this embodiment of the apparatus 1, the supporting unit 60 is not provided with a mechanical actuator for the pre-stretching rollers, but it includes a connection device, of a known type and not shown, to provide signals and controls, electric power, pneumatic energy to the unwinding unit 50, and in particular to the second motors 355.

The replacement procedure for the unwinding unit 50 mounted on board of the wrapping machine 10, with a new unwinding unit 50 located on the shuttles 21, 22 is substantially identical to the procedure described above with reference to the embodiment illustrated in FIG. 19. The supporting unit 60 is mounted on the second wrapping carriage 301 that slides along the second column 302 in the replacement configuration G to allow dismantling and mounting of the unwinding units 50.

It is suitable to point out that the apparatus of the invention can be also associated with a wrapping machine having a compact platform. In this case, the guide, is arranged externally to the working zone W at a distance that allows dismantling/mounting the unwinding units without interfering with the operation of the machine.

Figure 25:
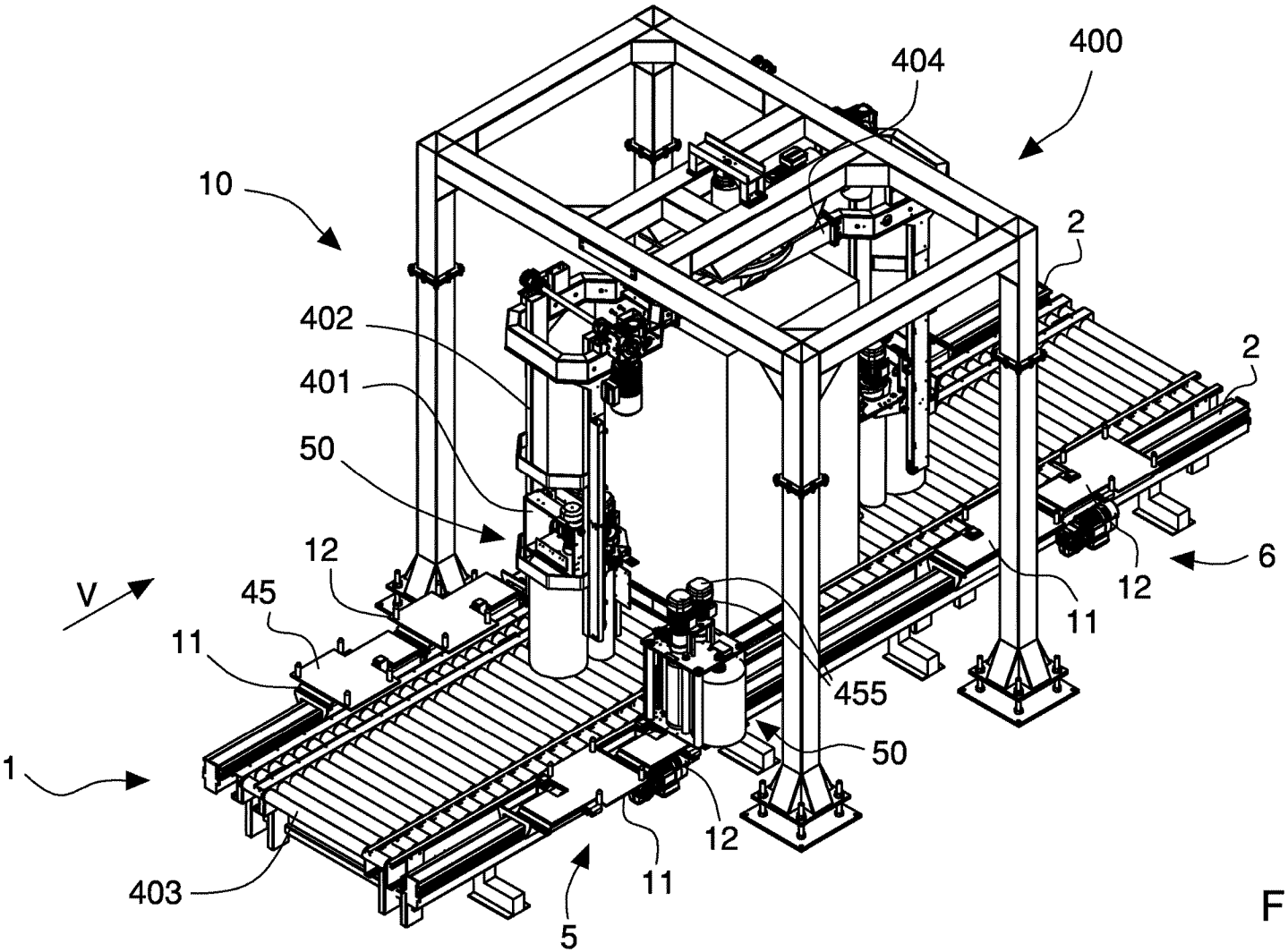
FIG. 25 is a perspective view of an apparatus of the invention associated with a wrapping machine provided with two rotating arms.
Figure 26:
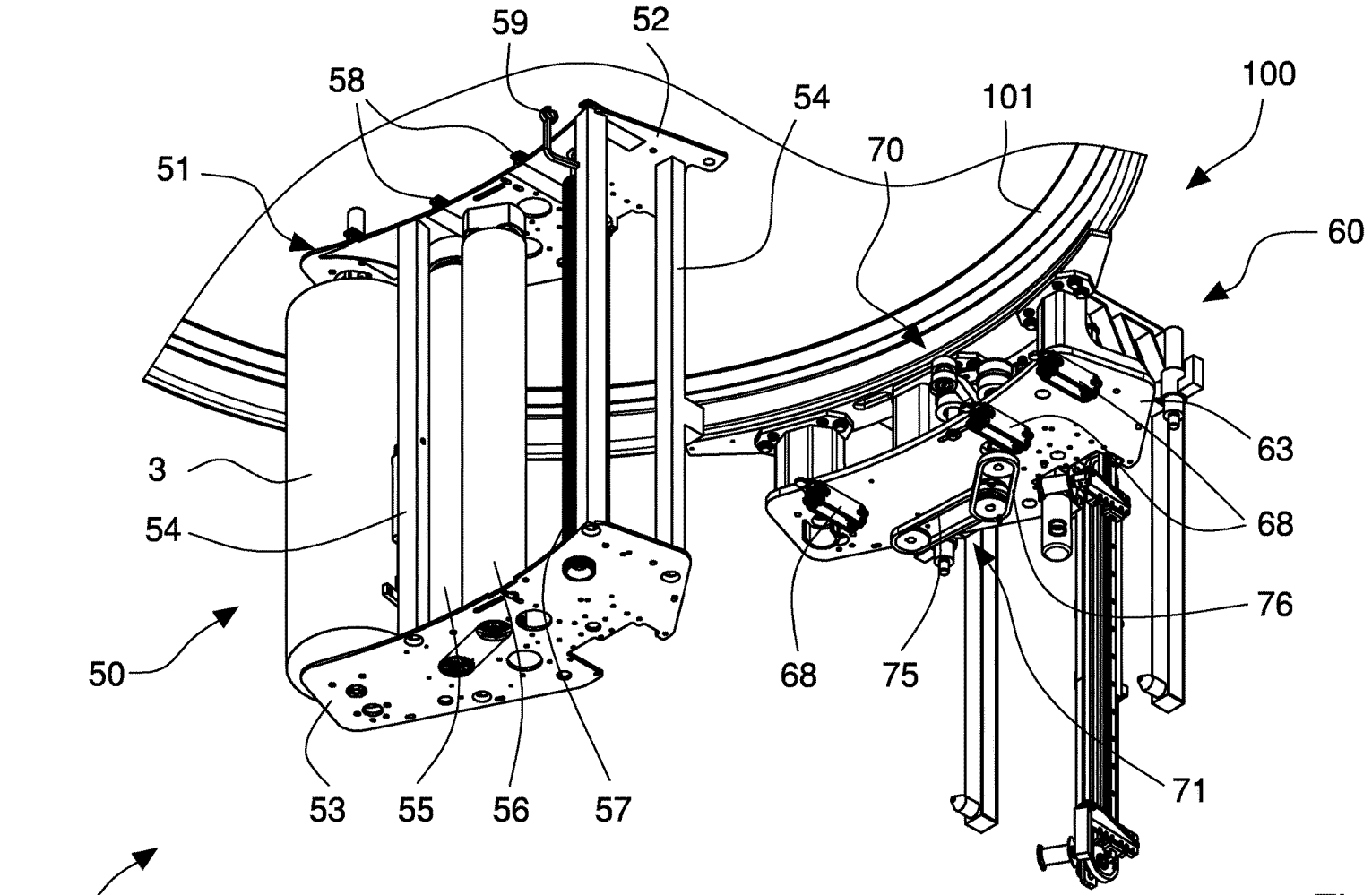
FIG. 26 is a partial bottom perspective view of the unwinding apparatus of the invention associated with a wrapping machine and including an unwinding unit and a supporting unit in a detached configuration.

FIG. 25 illustrates a further embodiment of the apparatus 1 to replace unwinding units of the invention, associated with a wrapping machine 10 of the double rotating arm type. In this wrapping machine, each supporting unit 60 is mounted on a third wrapping carriage 401 that is vertically movable along a respective vertical arm 402 fixed to a rotary cross beam 404 so as to rotate around the wrapping axis Z and the load L.

The third carriages 401, the vertical arms 402, and the rotary cross beam 404 act as a fourth movement mechanism 400 arranged for moving the supporting unit 60 and the unwinding unit 50 with respect to the load L.

To allow the simultaneous replacement of the two unwinding units 50 mounted on the two vertical arms 402, the apparatus 1 includes a guide 2 including two beams along which respective shuttles 11, 12 move. The guide is arranged for dismantling from the wrapping machine 10 and for receiving an unwinding unit 50 to be replaced, and for transferring and mounting a new unwinding unit 50 on the wrapping machine 10. The beams of the guide 2 are substantially rectilinear, mutually parallel and parallel to an advancing direction V of the load L and arranged at the sides of a supporting and advancing device 403 of the load L.

The unwinding units 50 are provided with a pair of third motors 455 for separately and independently driving the pre-stretching rollers.

The shuttles 11, 12 are substantially similar to those described above. The shuttles differ from those illustrated in the FIGS. 15 to 18 in that they include transfer devices 45 having different dimensions and shape.

In the embodiment illustrated in FIG. 25, the shuttles provided on respective beams of the guide 2 include a plurality of shuttles 11, 12 forming two distinct convoys. In particular, the shuttle means include a first pair of shuttles 11, 12 (driving shuttle 12 and driven shuttle 11) that forms a convoy 5 of shuttles, and a second pair of shuttles 11, 12 (driving shuttle 12 and driven shuttle 11) that forms a further convoy 6 of shuttles. Each convoy 5, 6 is drivable in an independent manner along a respective beam of the guide 2. In this manner, it is possible to provide up to three unwinding units 50 available for the mounting on the machine, to allow the latter to operate in a completely automatized manner, without the intervention of operators, for prolonged work shifts.

The replacement procedure for replacing the unwinding units 50 mounted on the vertical arms 402 of the wrapping machine 10 with the new unwinding units 50 located on the shuttles 11, 12 is substantially similar to the procedure described for the rotating ring wrapping machine shown in FIGS. 1 to 10. In this case, in the replacement configuration G of the wrapping machine 10, the two rotating arms 402 are located above the respective guide 2 to allow the shuttles 11, 12 in the first operating positions to dismantle the unwinding units 50 to be replaced from the supporting units 60.

Figure 31:
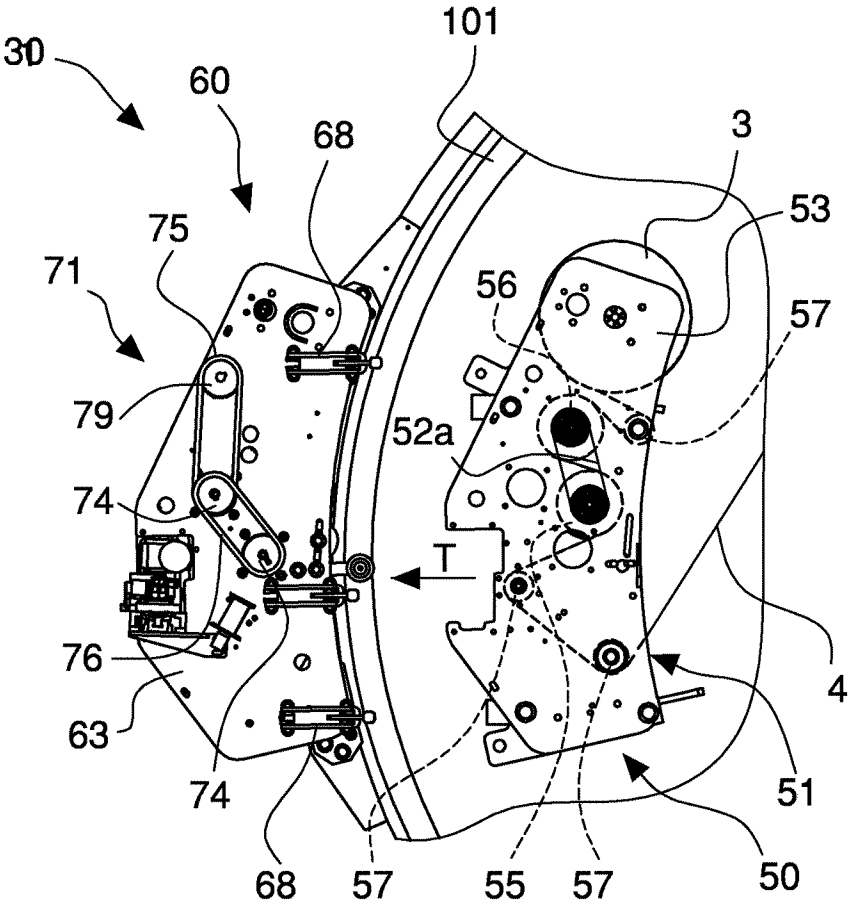
FIGS. 30 and 31 are plan views from the top and the bottom, respectively, of the unwinding unit and the supporting unit of the apparatus of FIG. 26 in a mounting step.
Figure 32:
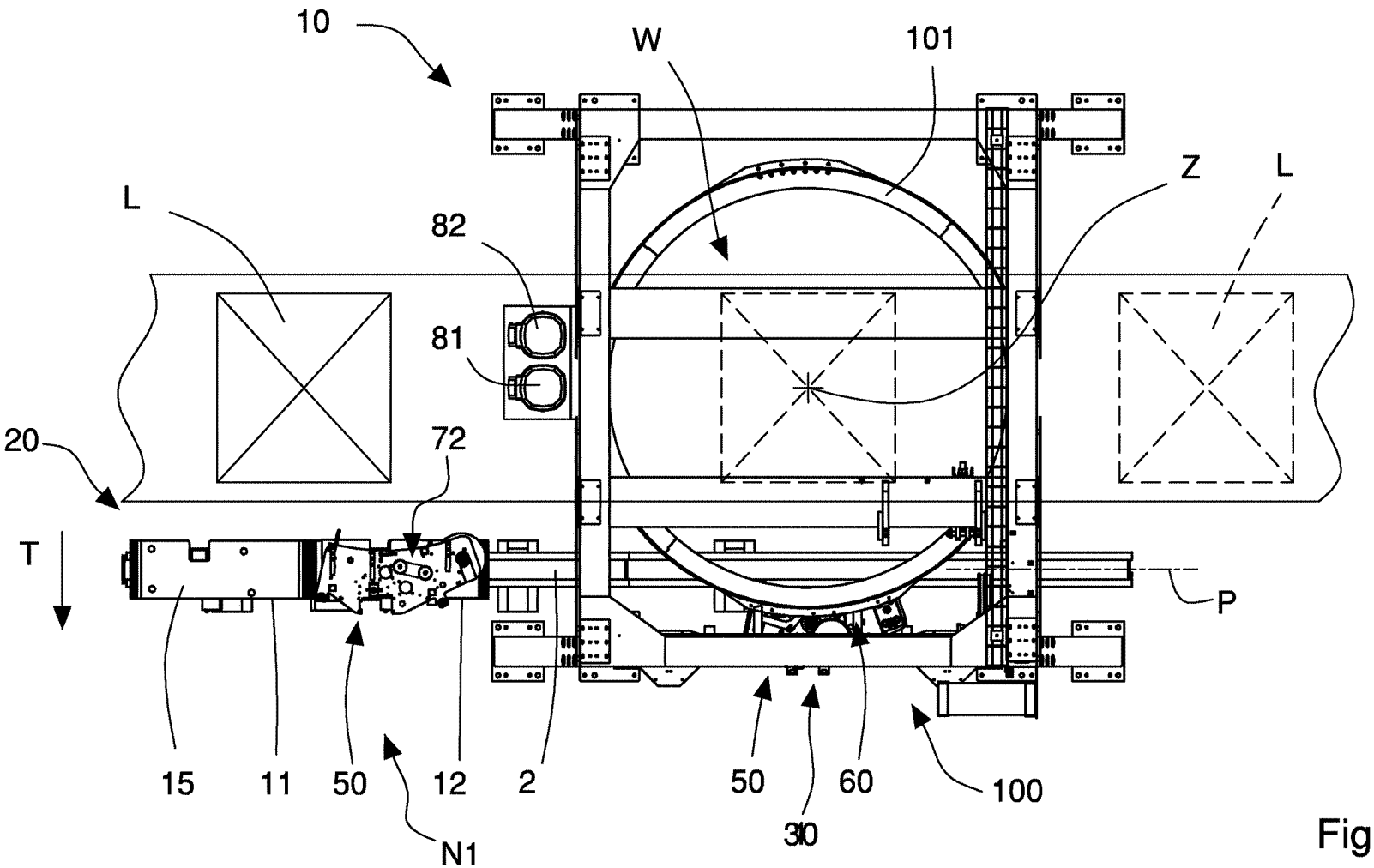
FIGS. 32 and 33 are plan views from the top and side, respectively, of the unwinding apparatus of the invention associated with a horizontal rotating ring wrapping machine.

With reference to the FIGS. 26 to 34, an unwinding apparatus 30 is illustrated which can be associated with a wrapping machine 10 arranged for wrapping or binding a load L with a film 4 of extensible plastic material. The wrapping machine 10 is of the horizontal rotating ring type, i.e. provided with a horizontal ring 101, which is rotating around a vertical wrapping axis Z, and which is vertically movable so as to wrap the load L with helical strips or bands of film 4 (FIG. 32). The ring 101 is rotatably supported by a frame of the machine, including a sliding frame (not illustrated) that is linearly movable along a movement direction that is vertical and substantially parallel to the wrapping axis Z.

Figure 27:
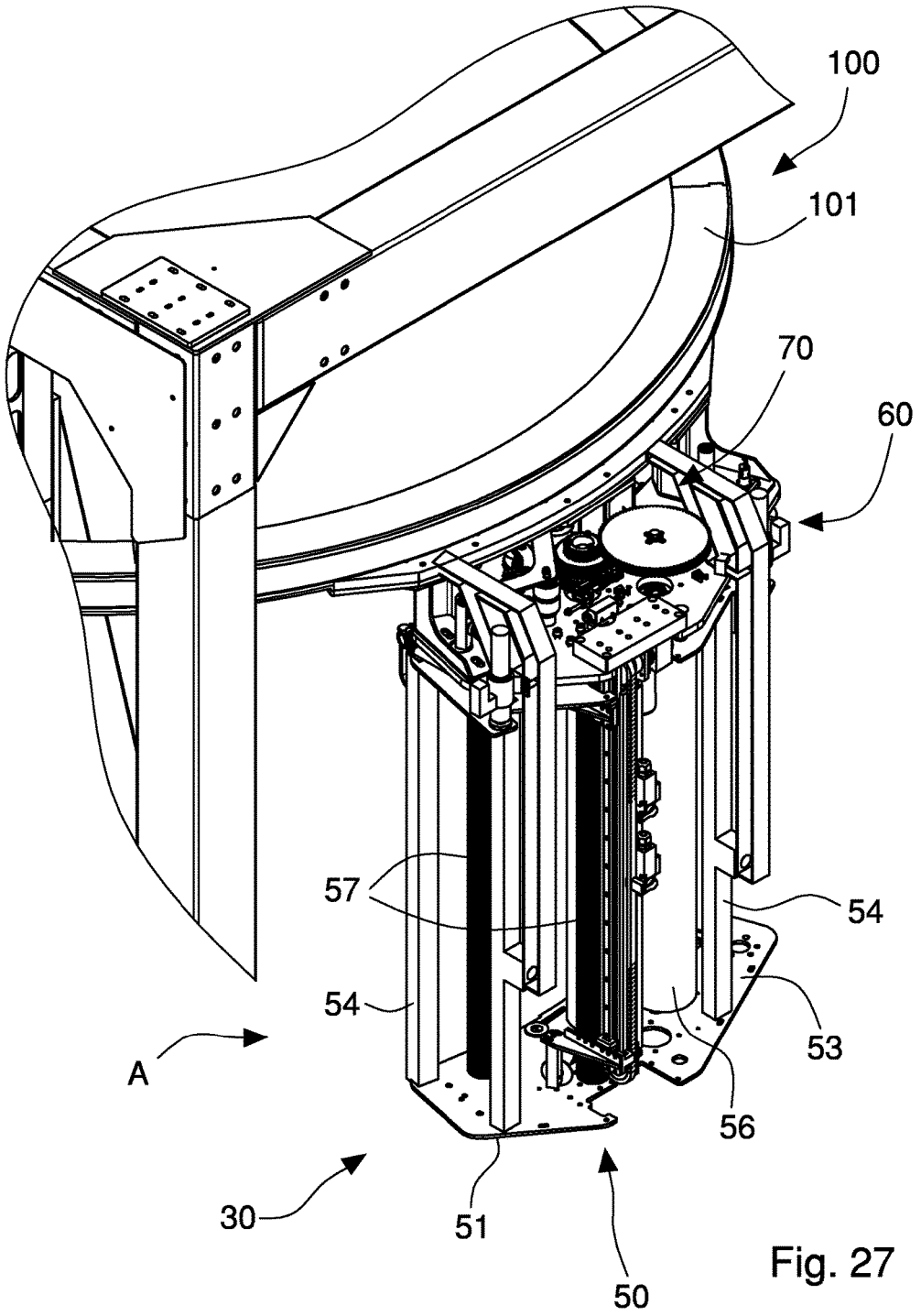
FIG. 27 is a top perspective view of the unwinding apparatus of FIG. 26 in an assembled configuration.

The unwinding apparatus 30 includes a supporting unit 60 that is fixed to the ring 101, and an unwinding unit 50 provided with a reel 3 of film 4, and which is removably or reversibly coupled to the supporting unit 60 in an assembled configuration A (FIG. 27). The ring 101 and the sliding frame act as a movement mechanism 100 arranged for moving the unwinding apparatus 30 with respect to the load L.

The unwinding unit 50 includes rollers 55, 56, 57 arranged for unwinding and pre-stretching the film 4. The rollers include a first pre-stretching roller 55 and a second pre-stretching roller 56 for unwinding the film 4 from the reel 3 and pre-stretching or elongating it by a preset amount or percentage. The rollers further include one or more guide or idle rollers 57 for guiding the film 4 from the reel 3 to the pre-stretching rollers 55, 56 and from the latter towards the load L to be wrapped.

As illustrated in detail in FIG. 31, the pre-stretching rollers 55, 56 and the guide rollers 57 are arranged on the winding unit 50 so as to wind the film 4 with an "S" pattern. Such "S" type winding allows the pre-stretching rollers 55, 56 to have a winding angle of the film greater than 180°, in particular greater than 270°. Large winding angles of the film 4 on the pre-stretching rollers 55, 56 optimizes the pre-stretching or elongation operation of the film. In particular, they allow high pre-stretch values, which limit the reduction in the height or width of the film band, and generally provide a better quality of film 4.

The pre-stretching rollers 55, 56 and the guide rollers 57 can be arranged on the winding unit 50 so as to implement other winding types of the film 4, for example, of the "W" type.

The supporting unit 60 is provided with a driving assembly 70 to drive the pre-stretching rollers 55, 56 in the assembled configuration A and in an operating condition of the wrapping machine 10 during the wrapping of the load L. In particular, the driving assembly 70 is configured to rotate the first pre-stretching roller 55 and the second pre-stretching roller 56 in a separated and independent manner.

The unwinding unit 50, as better explained in the description below, can be easily and quickly dismantled from the supporting unit 60 (typically, in the case of exhaustion or breakage or damage or jamming of the film) and replaced by an identical unwinding unit 50, but provided with a new film reel, one initial flap of which is properly wound on the rollers and ready to start the wrapping.

The unwinding unit 50 includes a supporting structure 51 suitable for supporting the reel 3 of film 4, and the rollers 55, 56, 57. The supporting structure 51 includes an upper portion 52 and a lower portion 53 formed by respective plates that are interconnected and spaced apart by a plurality of cross beams 54. The reel 3 of film 4, the pair of pre-stretching rollers 55, 56 and one or more guide or idler rollers 57 are rotatably connected to the upper plate 52 and the lower plate 53.

Figure 30:
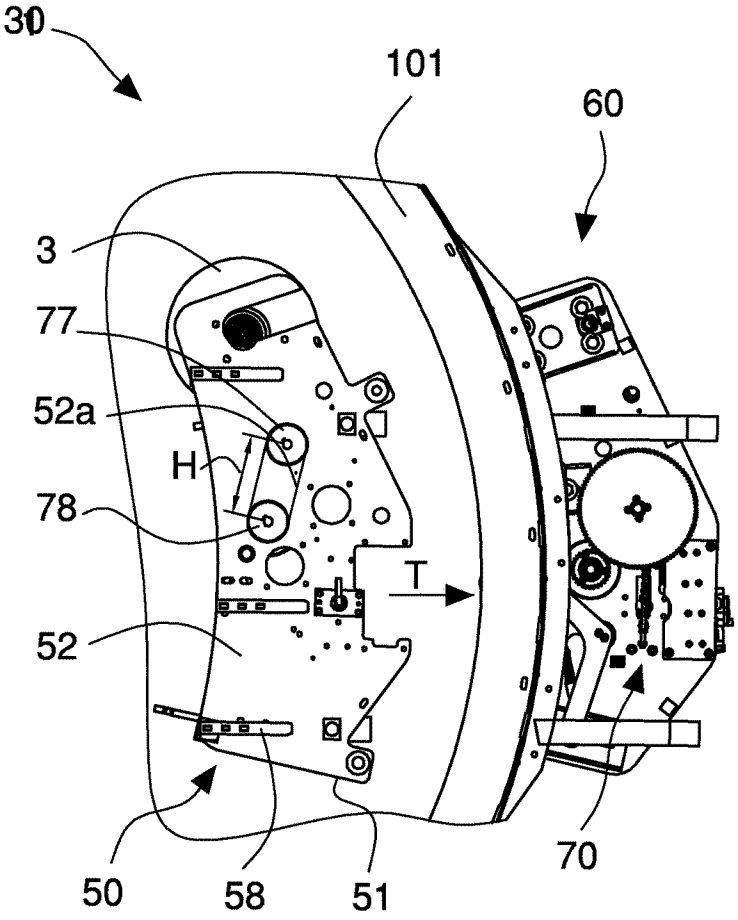

The first pre-stretching roller 55 and the second pre-stretching roller 56 are fixed in an adjustable manner to the supporting structure 51 to allow a varying interaxis H thereof (FIGS. 30 and 31). The upper plate 52 and the lower plate 53 are provided with respective through slots 52*a*, 53*a* for an adjustable connection of the pre-stretching rollers 54, 55.

Therefore, the unwinding apparatus 30 of the invention provides adjustment of the interaxis H between the two pre-stretching rollers 54, 55 to carry out an optimal unwinding and pre-stretching of the film 4 as a function of different characteristics of the film and operating requirements, such as, for example, the type of the material, the thickness, the height of the film, the diameter of the pre-stretching rollers, the covering factor of the film, the unwinding speed of the film, the pre-stretch percentage, and the dimensions and shape of the load to be wrapped.

The value of the interaxis H between the two rollers can be determined by tests and trials.

The unwinding unit 50 is further provided with gripping devices 59 to retain an initial flap of film 4 unwound from the reel 3 and wound around the pre-stretching 55, 56 and guide 57 rollers. The initial flap can be easily gripped by further gripping devices of a known type that are mounted on the wrapping machine 10.

The unwinding unit 50 includes a first coupling device 58 arranged to engage a second coupling device 68 of the supporting unit 60, the first coupling device 58 and the second coupling device 68 being mutually coupled or uncoupled along the operating direction T which is substantially horizontal.

The first coupling device includes a plurality of rails 58, for example, three, arranged for being slidably inserted in, and engaged with, respective seats 68 of the second coupling device. The seats are provided with horizontal and vertical idle wheels 69 to allow the sliding and centering of the respective rail 58. In this way, the seats 68 act as self-centering sliding blocks for the respective rails 58.

The first coupling device 58 is associated with the upper plate 52 of the supporting structure 51, while the second coupling device 68 is associated with a lower portion 63 of the supporting unit 60. In particular, the rails 58 are fixed to an outer face of the upper plate 52 while the seats 68 are fixed to a respective lower plate 63 of the supporting unit 60.

The seats 68 are provided with an abutment (not shown) which stops the further inserting and sliding of the rails 58, to stop the unwinding unit 50 in a coupling position with respect to the supporting unit 60.

The first coupling device 58 is insertable into the second coupling device 68 up to a complete coupling in the assembled configuration A along the operating direction T and with an advancing direction directed from the rotating axis (the wrapping axis Z of the unwinding unit 50 around the load L) outwardly, i.e. with a direction in accordance with the centrifugal force acting on the unwinding unit 50 when the latter is rotating around the load L. Owing to the configuration of the coupling device 58, 68, it is therefore the same centrifugal force that keeps the unwinding unit 50 properly assembled and connected to the supporting unit 60.

Therefore, the apparatus of the invention allows mounting and locking the unwinding unit 50 to the wrapping machine in a reversible and, at the same time, safe and reliable manner.

For greater safety, a locking device is provided, which is not shown in the figures, acting transversally to the direction T, in particular vertically, to lock the rails 58 in the seats 68 and, therefore, the unwinding unit 50 to the supporting unit 60 in the assembled configuration A.

With particular reference to FIGS. 26 to 34, the driving assembly 70 associated to the supporting unit 60 includes motors 81, 82 and a first transmission 71 driven by the motors 81, 82 and arranged for engaging and actuating a second transmission 72 of the pre-stretching rollers 55, 56.

Figure 28:
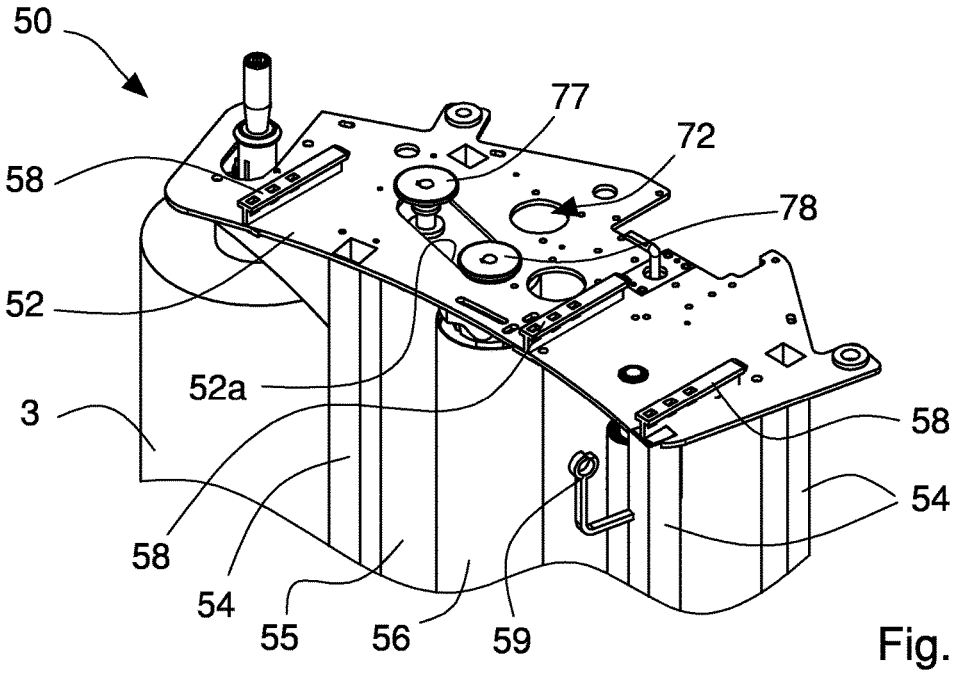
FIG. 28 is a fragmentary and partial perspective view of the unwinding unit of the apparatus of FIG. 26.
Figure 29:
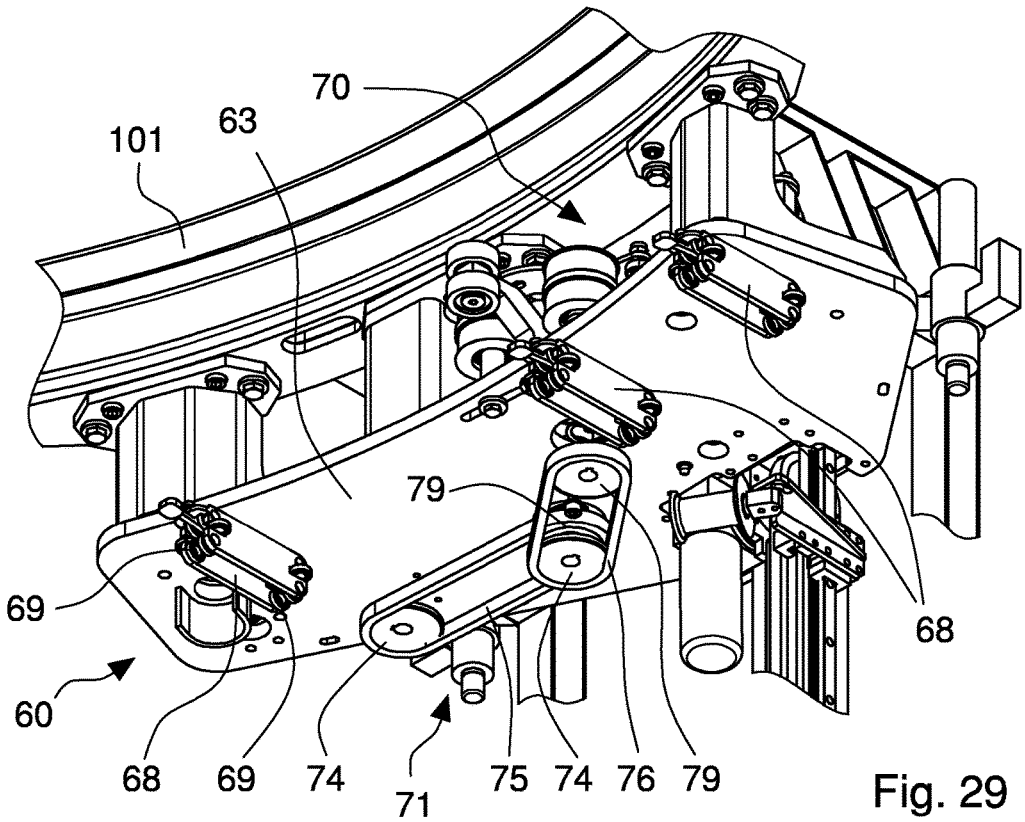
FIG. 29 is a partial and enlarged perspective view of the supporting unit of the apparatus of FIG. 26, fixed to a rotating ring of the wrapping machine.

With particular reference to the FIGS. 28 and 29, the first transmission 71 includes a first flexible element 75 and a second flexible element 76, for example, a pair of belts with double teeth or a pair of chains, each flexible element 75, 76 being drivable separately and independently from the motors 81, 82. The second transmission 72 includes a first coupling wheel 77 and a second coupling wheel 78, in particular, a pair of pulleys or gearwheels, associated with the first pre-stretching roller 55 and the second pre-stretching roller 56, respectively. In the assembled configuration A, each flexible element 75, 76 is arranged to engage and rotate the respective coupling wheel 77, 78.

In this way, the mot or s 81, 81 can rotate the pre-stretching rollers 55, 56. The length of the flexible elements 75, 76 is such as to ensure the engagement with the coupling wheels 77, 78 for any value of the interaxis H of the pre-stretching rollers 54, 55.

Each flexible element 75, 76 is supported and moved by a respective pair of support wheels 74, 79, one of which is idle (idle support wheel 74), and the other of which is motorized (motorized support wheel 79). The support wheels 74, 79 include pulleys or gearwheels. The motorized support wheels 79 are rotated by the mot or s 81, 82 including at least one rotating electric motor located on the supporting unit 60 or fixed to the sliding frame of the wrapping machine 10.

In the embodiment illustrated in FIGS. 26 to 34, the motors include a first motor 81 and a second motor 82 that are fixed to the sliding frame of the wrapping machine and connected to the first transmission 71 by a third transmission 73. The third transmission includes, for example, a first flexible element 85 and a second flexible element 86, for example a pair of toothed belts or a pair of chains, driven by the first motor 81 and the second motor 82, respectively, and driving, by suitable idle and transmission elements, the respective motorized support wheels 79 of the first transmission 71. Such a transmission system is disclosed in the international patent application WO2008/007189.

The two motors 81, 82, while being fixed to the sliding frame and, therefore, not being fixed to the rotating ring 101, can in this way drive in an independent manner the respective pre-stretching rollers 55, 54, thus allowing varying rotation speeds of the latter and, in particular, the pre-stretch ratio, also during the operation of the wrapping machine.

In a non-illustrated embodiment, the motor of the driving assembly 70 includes only one motor arranged on the sliding frame and actuating both the pre-stretching rollers 54, 55 by the third transmission. In this embodiment, the third transmission includes known devices to transmit rotation with different speeds to the two pre-stretching rollers 55, 56.

Owing to the unwinding apparatus 30 of the invention, it is thus possible to rapidly and easily dismantle an unwinding unit 50 to be replaced (in the case of exhaustion or breakage or damage or jamming of the film) and to replace it with an identical unwinding unit 50, but provided with a new film reel, an initial flap of which is properly wound on the roller and ready to start the wrapping. Since the driving assembly 70 is provided on the supporting unit 60 fixed to the machine, each unwinding unit 50 (including only the film reel and the pre-stretching and guide rollers) is relatively inexpensive and easy to make. At the same time, since the above-mentioned unwinding unit 50 includes all the pre-stretching and guide rollers around which the initial film flap retained by the gripping device 59 is wound, the proper automatic start of the wrapping procedure is always ensured.

The pre-stretching rollers 55, 56 and the guide rollers 57 can be arranged to carry out a winding of the film 4 of the so-called "S" type that provides a winding on the pre-stretching rollers 55, 56 at an angle greater than 180°, in particular up to and beyond 270°. High winding angles of the film on the pre-stretching rollers 55, 56 optimizes the pre-stretching or elongating operation of the film to provide high pre-stretch values, limiting a height or width reduction of the film band and, in general, obtaining a better quality of the film.

Figure 35:
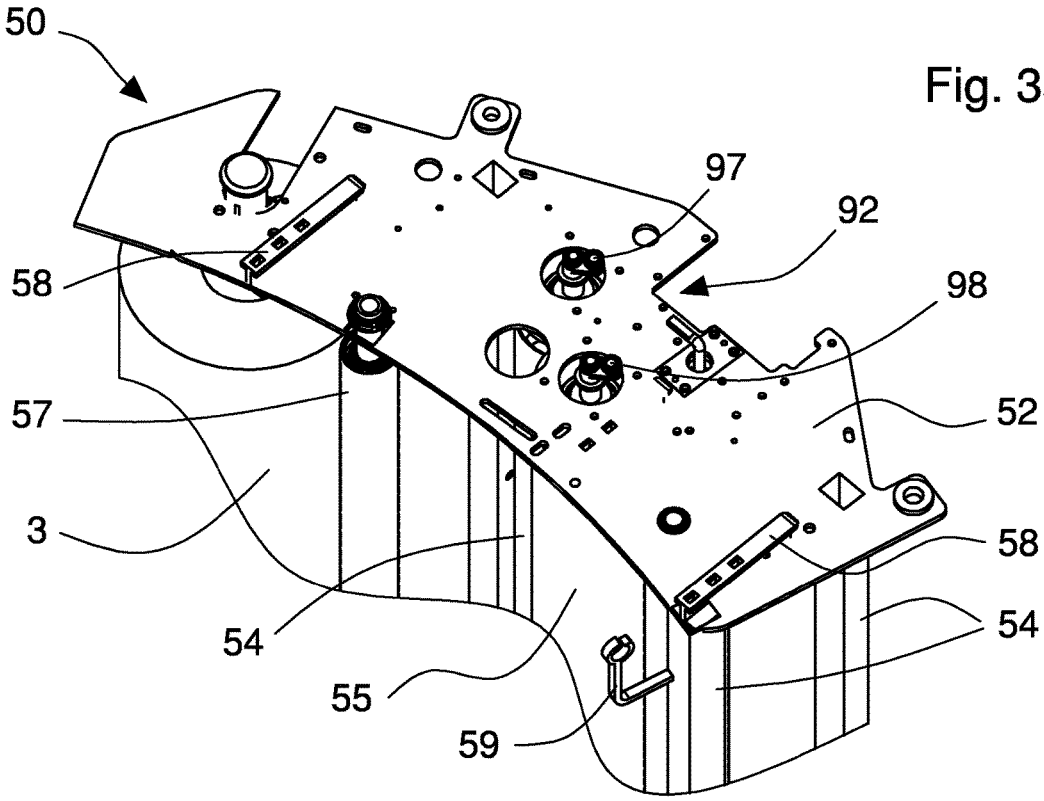
FIG. 35 is a fragmentary and partial perspective view of an unwinding unit of a version of the unwinding apparatus of FIG. 26.
Figure 36:
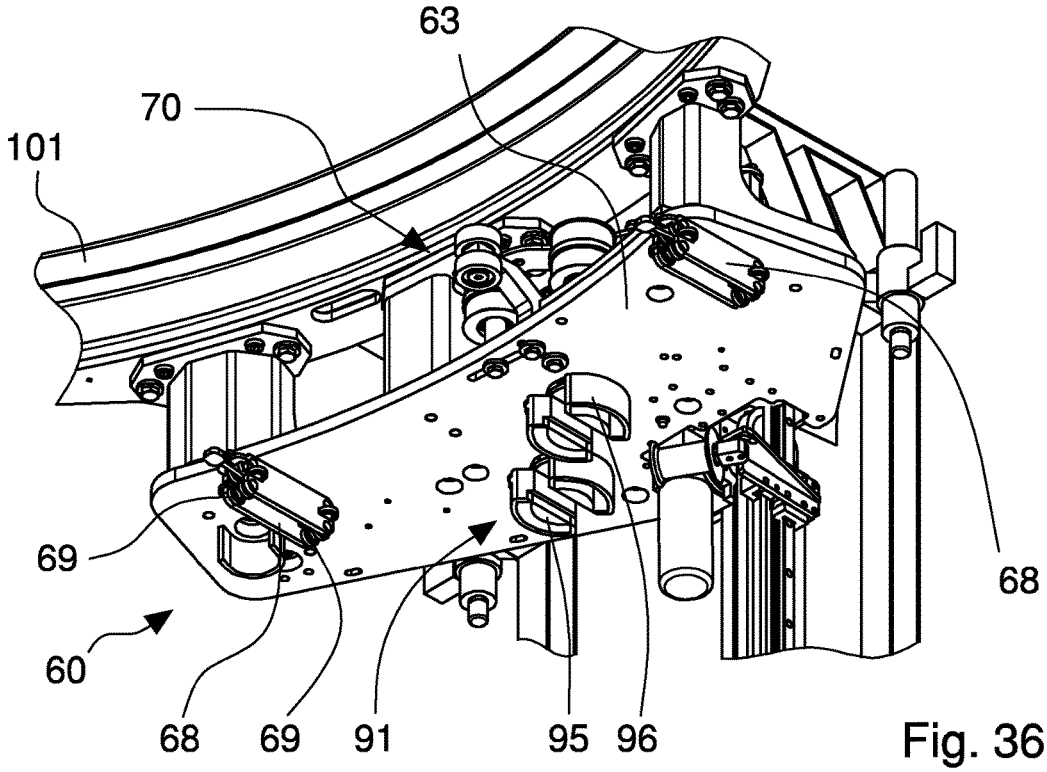
FIG. 36 is a partial and enlarged perspective view of the supporting unit, fixed to a rotating ring of the wrapping machine, of the version of the unwinding apparatus of FIG. 35.
Figure 37:
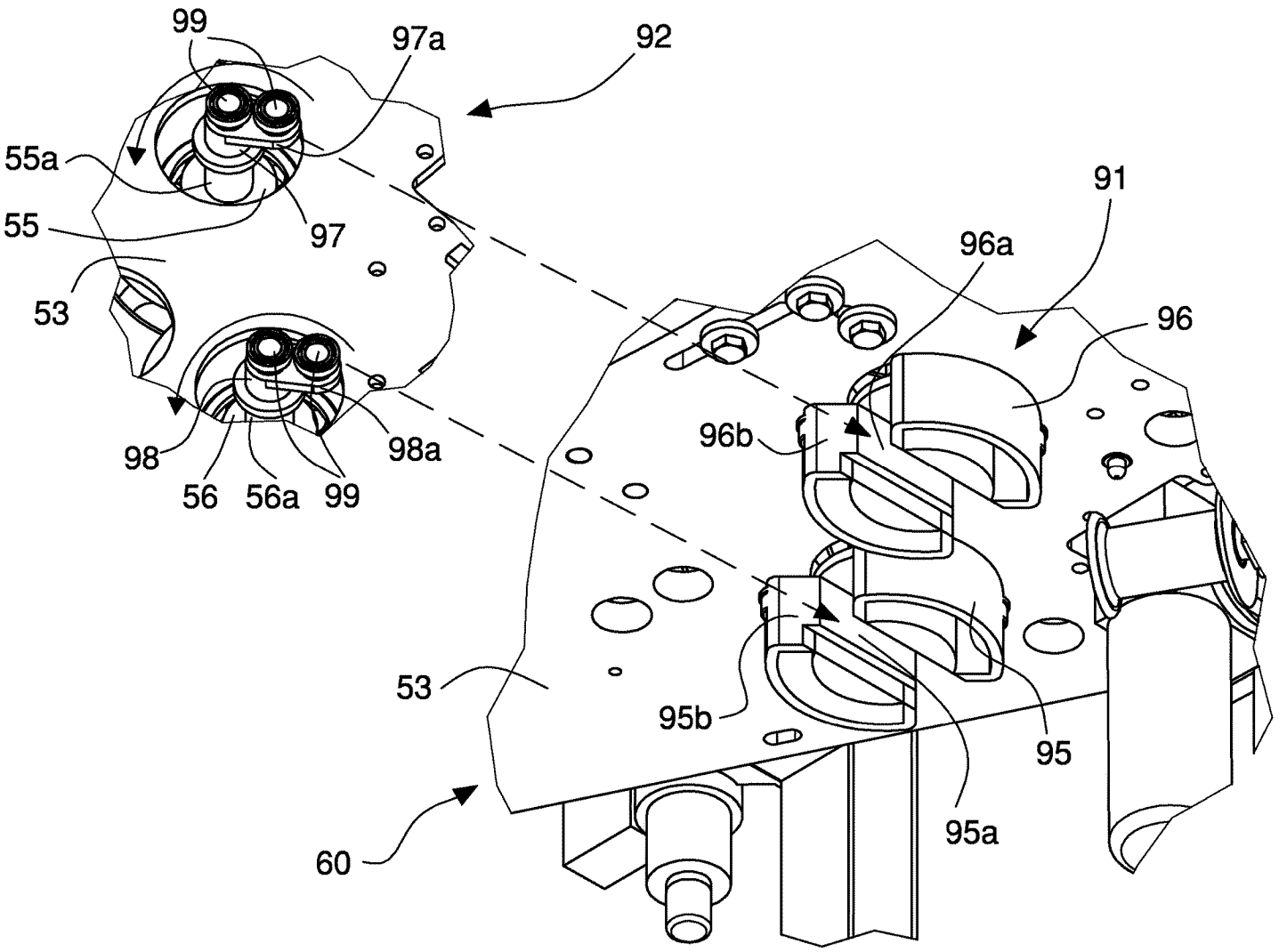
FIG. 37 is a partial and enlarged perspective view of the unwinding apparatus of FIGS. 35 and 36, illustrating in particular first and second transmissions.

FIGS. 35 to 37 illustrate a version of the unwinding apparatus 30 of the invention that differs from the embodiment described above for the transmission. In fact, the first transmission 91 of the driving assembly 70 includes a pair of movable members 95, 96 configured for engaging and moving a pair of follower members 97, 98 of the second transmission 92 associated to respective pre-stretching rollers 55, 56 on the unwinding unit 50. In particular, the first transmission 91 includes a first movable element 95 and a second movable element 96 driven by the motor and arranged to drive a first follower member 97 and a second follower member 98, respectively, of the second transmission 92.

Each movable element 95, 96 includes a bush of a substantially cylindrical shape, that can be rotated around a respective longitudinal axis by the motor and provided with a transverse seat 95*a*, 96*a*, in particular a substantially diametric through seat, arranged for slidably receiving a coupling portion of the respective follower member 97, 98.

Each follower member 97, 98 includes an eccentric pin or a crank fixed to an end of a shaft 55*a*, 56*a* for the support and rotation of the corresponding pre-stretching roller 55, 56, and provided with an eccentric portion 97*a*, 98*a* that is suitable to engage the transverse seat 95*a*, 96*a* of the respective bush 95, 96.

In order to simplify the mounting of the unwinding unit 50 on the supporting unit 60, eccentric portions 97*a*, 98*a* are progressively inserted in the respective transverse seats 95*a*, 96*a*, the latter have a tapered side opening or promoting portion 95*b*, 96*b* being substantially "V"-shaped. Furthermore, the eccentric portions 97*a*, 98*a* of the follower members 97, 98 are provided with a pair of wheels 99, for example roller bearings, which can slide by rotating on opposite side walls of the transverse seats 95*a*, 96*b*. In the assembled configuration A, the eccentric portions 97*a*, 98*a* are completely housed within the transverse seats 95*a*, 96*b*. The bushes 95, 96, rotated by the motor around the respective longitudinal axes, impart with the respective transverse seats 95*a*, 96*a* on the wheels 99, and therefore on the eccentric pins 97, 98, a torque or moment of forces that rotates the pre-stretching rollers 55, 56.

Figure 33:
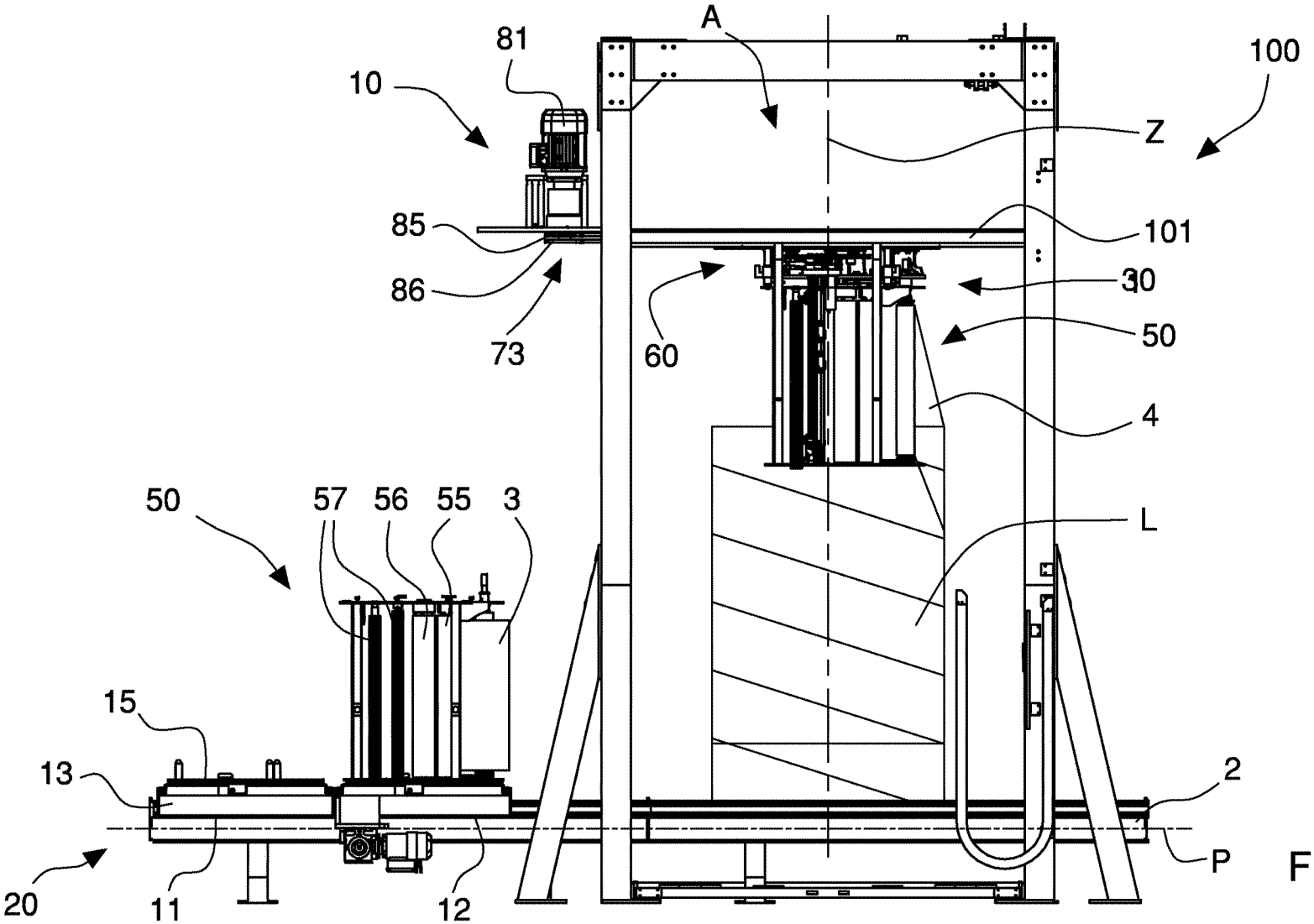
Figure 34:
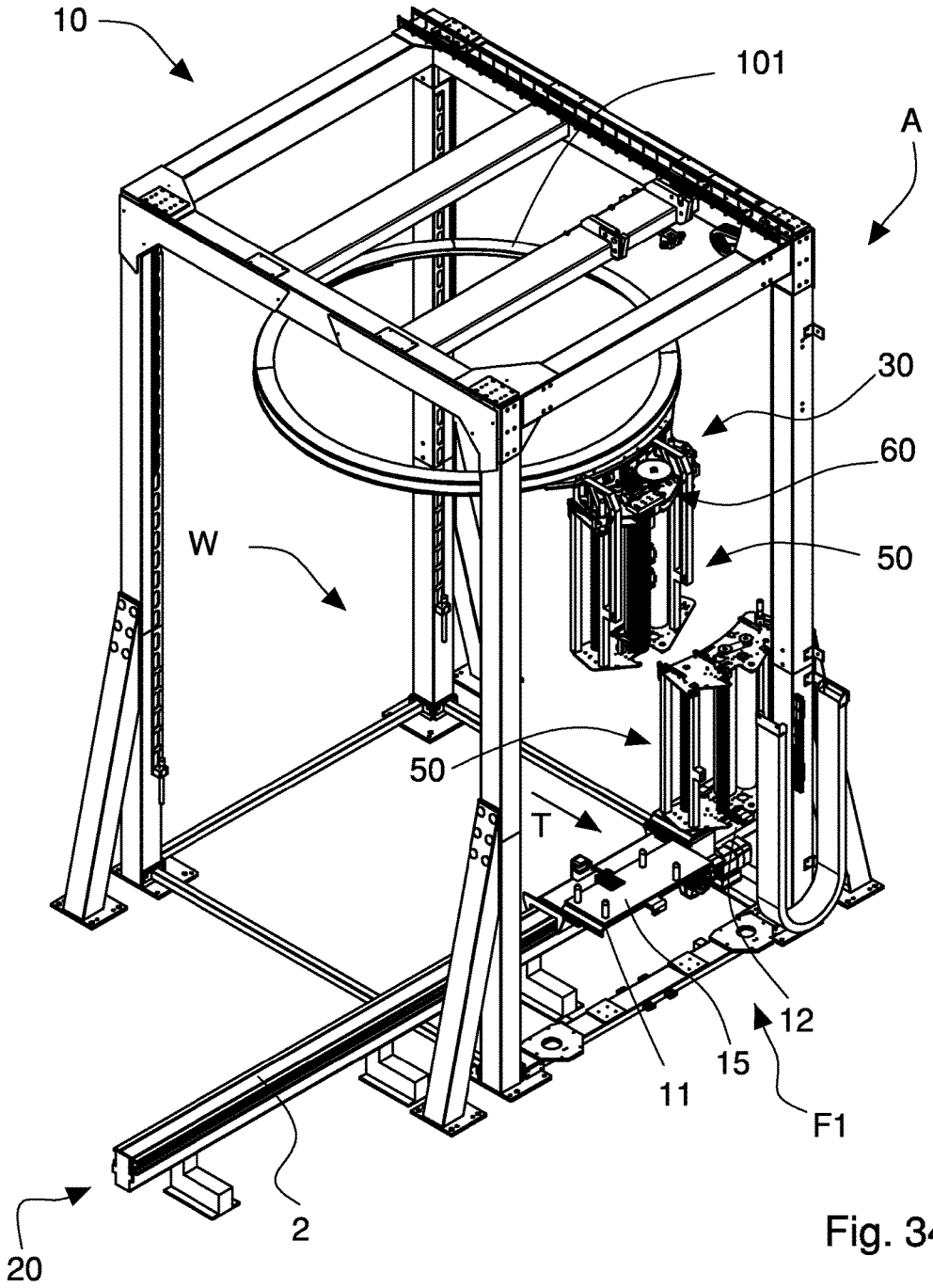
FIG. 34 is a perspective view of the apparatus and the machine of FIG. 32, in which some details have been removed, and in a replacement step of an unwinding unit.

As illustrated in the FIGS. 32 to 34, the wrapping machine 10 can include a replacement apparatus 20 capable of automatically replacing an unwinding unit 50 of the unwinding apparatus 30 associated with the above-mentioned machine, in particular, capable of dismantling and receiving, from a supporting unit 60 fixed to the movement mechanism 100, an unwinding unit 50 to be replaced or capable of transferring and mounting a new or replacement unwinding unit 50 on the supporting unit 60. The supporting unit to be replaced is a unit having an exhausted film reel 3 or with the above-mentioned film that is broken, damaged, or jammed. The replacement unwinding unit is a unit provided with a new film reel, in which the initial flap of film 4 unwound from the reel is retained by the gripping device 59 and wound around the pre-stretching 55, 56 and guide 57 rollers.

The replacement apparatus 20 includes, for example, shuttles 11, 12 that are movable on guide 2 along a path P, and arranged to house at least one unwinding unit 50 to be replaced and to be dismantled from the wrapping machine 10 and to support at least one replacement unwinding unit 50 to be mounted on the wrapping machine 10.

The shuttles 11, 12 include transfer devices 15 suitable for receiving and supporting at least one unwinding unit 50, and movable between a retracted position and an extended position along the operating direction T to allow the shuttles 11, 12 to selectively dismantle and receive an unwinding unit 50 to be replaced or to transfer and mount a replacement unwinding unit 50.

The operating direction T along which the transfer device 15 is moved is substantially radial to a circular winding trajectory of the film 4 around the load L and transverse, in particular, orthogonal, to the path P.

The shuttles include a plurality of shuttles 11, 12, for example, two, as in the illustrated embodiment, which are mutually connectable so as to form at least one convoy of shuttles, each shuttle including a respective transfer device 15 for supporting and moving at least one respective unwinding unit 50.

Each shuttle 11, 12 includes a carriage 13 provided with sliding wheels and configured to engage and slide on the guide 2. The transfer device is slidably connected to the carriage 13, including a transfer platform 15 fixed by telescopic guides to end portions of the above-mentioned carriage 13 so as to be movable between the retracted position and the extended position along the operating direction T. The replacement or changing procedure of an unwinding unit 50 to be replaced, mounted on board of the wrapping machine 10, with a replacement unwinding unit 50 located on the shuttles 11, 12 in an initial step, moves the shuttles 11, 12 from a inactive position N1, outside a working zone W of the wrapping machine 10 (FIG. 32), to a first operating position F1 within the working zone W (FIG. 34). In the first operating position F1, the free shuttle is precisely under the rotating ring 101, while the transfer device 15 is in the extended position to receive the unwinding unit 50 to be replaced.

The rotating ring 101 of the wrapping machine 10 is then vertically lowered to rest the unwinding unit 50 to be replaced on the platform of the transfer device 15 of the shuttle. The transfer device 15 is then actuated in the retracted position to allow the unwinding unit 50 to be replaced to be disengaged and dismantled from the supporting unit 60 that is fixed to the rotating ring 101.

The shuttles 11, 12 are moved to a second operating position, in which the shuttle provided with unwinding units 50 is at the supporting unit 60. At this point, the transfer device 15 of the shuttle 12 is moved in the extended position in order to mount the replacement unwinding unit 50 on the supporting unit 60. More precisely, the first coupling device 58 is slidably inserted into the second coupling device 68. In a successive operating wrapping step, the second transmission 72 engages the first transmission 71 to allow the motors 81, 82 to rotate the pre-stretching rollers 55, 56. Once the unwinding unit 50 has been mounted on the supporting unit 60, the rotating ring 101 is vertically moved to disengage the unwinding unit 50 from the shuttle 12.

Owing to the replacement apparatus 20, it is possible to automatically, rapidly and efficiently replace an unwinding unit 50 in a wrapping machine 10, without any intervention by operators. Furthermore, the wrapping machine 10 provided with the apparatus of the invention 20 can operate in a completely automatized manner, without the intervention of operators, for prolonged work shifts, since the shuttles 11, 12 can support, and therefore replace, a plurality of unwinding unit 50 arranged on respective shuttles.

A number of substitute unwinding units 50 can be provided for, in order to allow prolonged work shifts of the machine, without unduly affecting the whole cost of the machine itself.

Figure 38:
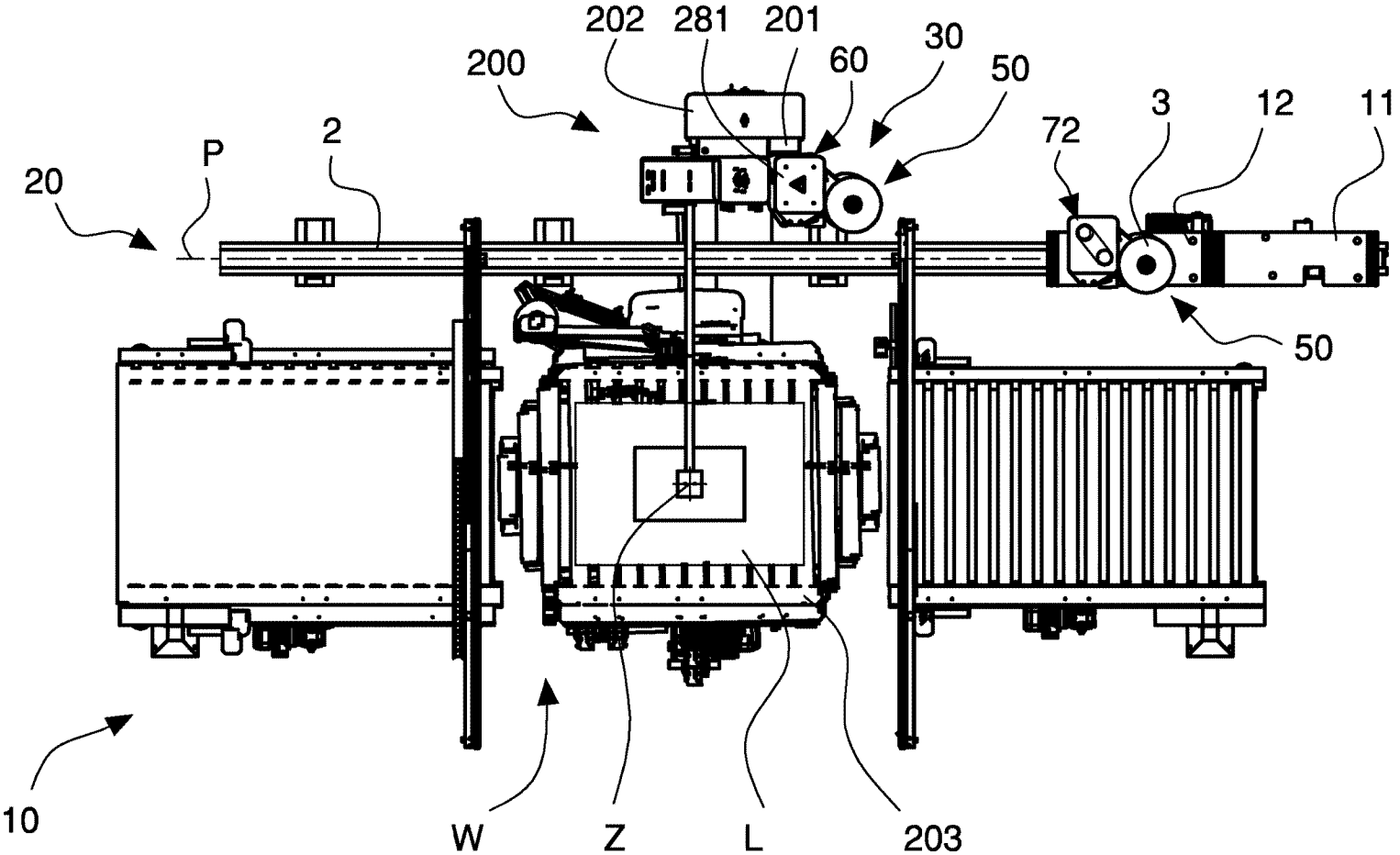
FIG. 38 is a plan view of another version of the unwinding apparatus associated with a rotating table wrapping machine.

FIG. 38 illustrates an embodiment of the unwinding apparatus 30 of the invention associated with a wrapping machine 10 of the rotating table, or rotary platform, type. In this wrapping machine 10, the supporting unit 60 of the apparatus 1 is mounted on a first wrapping carriage 201 that is vertically movable along a fixed first column 202, while the load L is rotated around the wrapping axis Z by the rotating table 203 on which it is located. The first wrapping carriage 201 and the first column 202 act as a second movement mechanism 200 that is arranged for moving the supporting unit 60 and the unwinding unit 50 with respect to the load L.

Such an embodiment of the unwinding apparatus 30 differs from the above-described embodiment in that the motor 281 of the driving assembly 70 includes a motor mounted on the supporting unit 60. Such motor 281 directly drives the first transmission 71 which engages and moves the second transmission 72 of the pre-stretching rollers 54, 55.

Also in this case, the wrapping machine 10 is provided with a replacement apparatus 20 including shuttles 11, 12 suitable to dismantle and receive from the wrapping machine 10 an unwinding unit 50 to be replaced, and thus, to transfer and mount a replacement unwinding unit 50 on the wrapping machine 10.

Figure 39:
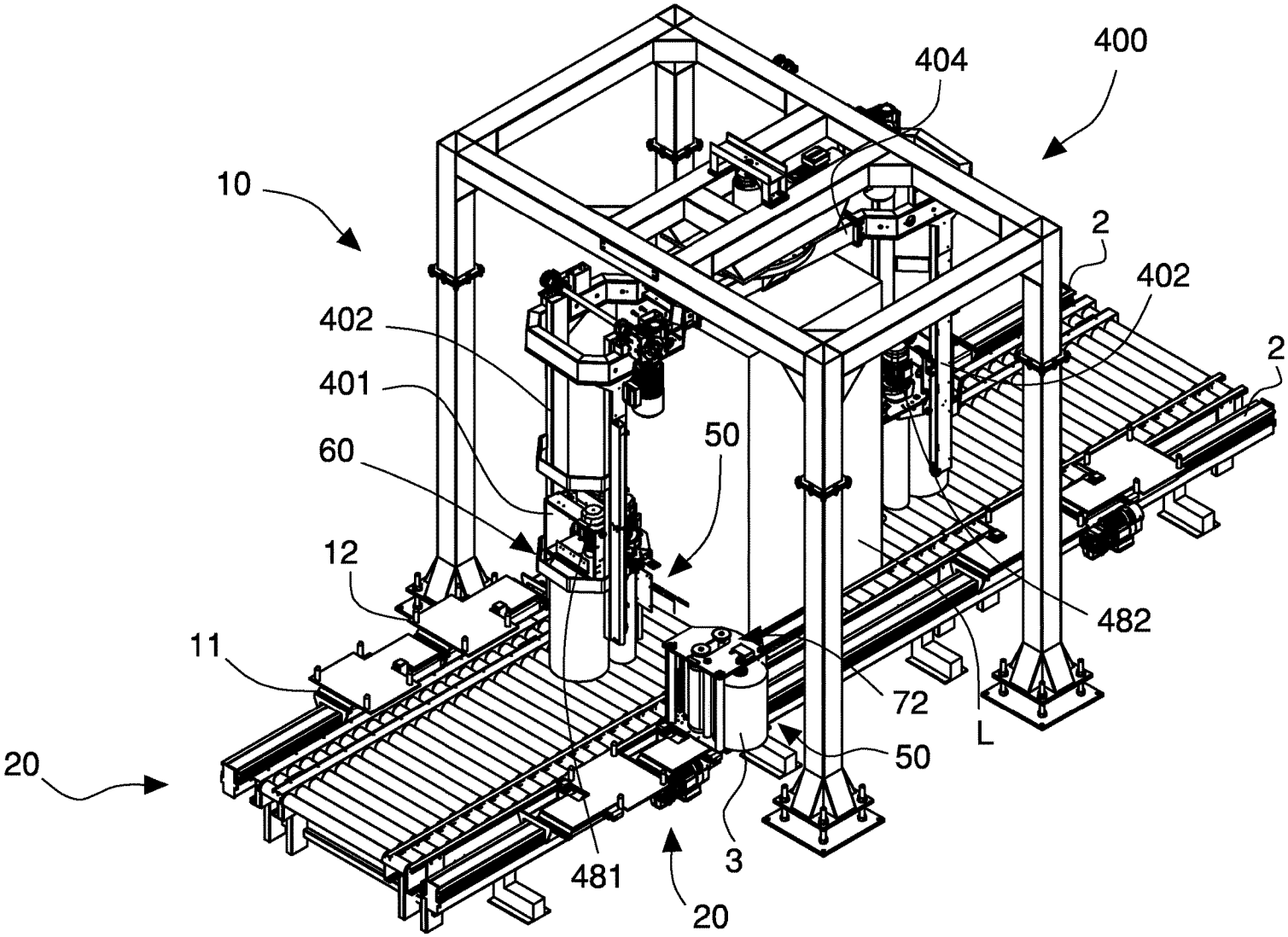
FIG. 39 is a perspective view of a further version of the unwinding apparatus of the invention, associated with a double rotating arm wrapping machine.

FIG. 39 illustrates a further version of the unwinding apparatus 30 of the invention associated with a wrapping machine 10 of the double rotating arm type. In this wrapping machine, two unwinding devices 1 are provided, each of which is associated with a respective rotating arm 402. In particular, the supporting unit 60 of each apparatus 1 is mounted on a third wrapping carriage 401 that is vertically movable along a respective vertical arm 402, the latter being fixed to a rotary cross beam 404, so as to rotate around the wrapping axis and the load L.

The third carriages 401, the vertical arms 402, and the rotary cross beam 404 act as a fourth movement mechanism 400 that is arranged for moving the supporting unit 60 and the unwinding unit 50 with respect to the load L.

The driving assembly 70 of each apparatus 1 includes a pair of motors 481, 482 that are fixed to the respective supporting unit 60 and arranged for driving separately and independently the pre-stretching rollers by the first transmission 71 and the second transmission 72.

The replacement apparatus 20 allows the simultaneous replacement of the two unwinding units 50 mounted on the two vertical arms 402. The replacement apparatus is provided with guides 2 including two beams along which respective shuttles 11, 12 move. The guide is arranged to dismantle from the wrapping machine 10 and to receive an unwinding unit 50 to be replaced or to transfer and mount a new unwinding unit 50 on the wrapping machine 10.

Therefore, the unwinding apparatus 30 of the invention can be efficiently and advantageously employed on different types of wrapping machines, since the driving assembly 70, associated with the supporting unit 60 fixed to the movement mechanisms 100, 200, 400 of the wrapping machine includes a motor that can be located directly on the above-mentioned supporting unit (for example, in the case of rotating arm or rotating table wrapping machines) or onto a frame of the wrapping machine (for example rotating ring wrapping machines).

The invention claimed is:

1. A wrapping machine, comprising (a) at least one new unwinding unit for wrapping a load with a film, said at least one new unwinding unit including a first coupling device;

(b) a shuttle assembly movable along a path, for receiving and supporting said at least one new unwinding unit to be mounted on the wrapping machine or an empty unwinding unit to be removed from the wrapping machine, said shuttle assembly operating along a horizontal operating direction to dismantle and receive the empty unwinding unit from the wrapping machine and transfer and mount said at least one new unwinding unit; and (c) a support unit connected with the wrapping machine and including a second coupling device for connection with said first coupling device of said at least one new unwinding unit and for supporting said at least one new unwinding unit, said first and second coupling devices operating in said horizontal operating direction, said shuttle assembly comprising a transfer device for supporting and moving said at least one new unwinding unit, said transfer device being displaceable along said horizontal operating direction between a retracted position and an extended position for fully dismantling and receiving the empty unwinding unit to be replaced, and for transferring and fully mounting said at least one new unwinding unit in a single step and with a single horizontal movement, said horizontal operating direction being transverse to said path and said first coupling device comprising a set of rails slidably arranged within and engaged with respective seats of said second coupling device along said horizontal operating direction, said first coupling device being inserted in said second coupling device up to a coupling position wherein said at least one new unwinding unit is engaged with and supported by said supporting unit.

2. Apparatus as defined in claim 1, wherein said shuttle assembly is displaced along said path between a first operating position for dismantling and receiving an unwinding unit to be replaced from the wrapping machine, a second operating position for transferring and mounting a new unwinding unit on the wrapping machine, and an inactive position wherein said shuttle assembly is outside a working zone of the wrapping machine so as not to interfere with the operation of the wrapping machine.

3. Apparatus as defined in claim 1, wherein said shuttle assembly includes an actuator for moving said shuttle assembly along said path.

4. The wrapping machine as defined in claim 1, wherein said shuttle assembly includes at least one shuttle provided with an actuator for moving said shuttle along said path, said shuttle further supporting said at least one new unwinding unit or the empty unwinding unit.

5. Apparatus as defined in claim 1, wherein said shuttle assembly comprises a plurality of shuttles which are connected to form a convoy of shuttles, at least one shuttle including an actuator for moving said convoy of shuttles along said path.

6. The wrapping machine as defined in claim 5, wherein each shuttle of the convoy of shuttles supports said at least one new unwinding unit or the empty unwinding unit and includes a transfer device for supporting and moving said at least one new unwinding unit or the empty unwinding unit.

7. Apparatus as defined in claim 1, and further comprising a guide extending along said path through a working zone of the wrapping machine substantially rectilinear and parallel to an advancing direction of the load, said shuttle assembly sliding along said guide.

8. The wrapping machine as defined in claim 1, and further comprising a movement mechanism connected with the wrapping machine for moving said support unit and said at least one new unwinding unit coupled therewith with respect to the load.

9. The wrapping machine as defined in claim 1, wherein said first and second coupling devices are coupled along said operating direction with respect to a rotational axis of said at least one new unwinding unit, whereby during rotation of said at least one new unwinding unit, a centrifugal force acting on said at least one new unwinding unit maintains said at least one new unwinding unit in engagement with and supported by said support unit in a coupling position.

10. The wrapping machine as defined in claim 1, and further comprising a locking device for locking said at least one new unwinding unit to said support unit in a coupling position in which said at least one new unwinding unit is engaged with and supported by said support unit.

* * * * *